US009961981B2

(12) United States Patent
Lee et al.

(10) Patent No.: US 9,961,981 B2
(45) Date of Patent: May 8, 2018

(54) APPARATUS FOR AUTOMATICALLY FILLING PIPETTE

(71) Applicants: F.S. KOREA INDUSTRIES INC., Seoul (KR); Young Joo Lee, Anyang-si (KR)

(72) Inventors: Young Joo Lee, Anyang-si (KR); Jae Kwang Hwang, Seoul (KR)

(73) Assignees: F.S. KOREA INDUSTRIES INC., Seoul (KR); Young Joo Lee, Anyang-si, Gyeonggi-do (KR)

( * ) Notice: Subject to any disclaimer, the term of this patent is extended or adjusted under 35 U.S.C. 154(b) by 234 days.

(21) Appl. No.: 14/899,108

(22) PCT Filed: Jul. 7, 2014

(86) PCT No.: PCT/KR2014/006042

§ 371 (c)(1),
(2) Date: Dec. 16, 2015

(87) PCT Pub. No.: WO2015/023061

PCT Pub. Date: Feb. 19, 2015

(65) Prior Publication Data

US 2016/0150867 A1 Jun. 2, 2016

(30) Foreign Application Priority Data

Aug. 14, 2013 (KR) ..... 10-2013-0096697
Feb. 17, 2014 (KR) ..... 10-2014-0017771

(51) Int. Cl.
*B65B 31/02* (2006.01)
*B01L 3/02* (2006.01)
(Continued)

(52) U.S. Cl.
CPC ..... *A45D 34/00* (2013.01); *A45D 34/04* (2013.01); *B05B 11/3035* (2013.01); *B05B 11/3047* (2013.01); *A45D 2200/056* (2013.01)

(58) Field of Classification Search
CPC combination set(s) only.
See application file for complete search history.

(56) References Cited

U.S. PATENT DOCUMENTS 4,579,153 A * 4/1986 Goncalves ..... B01L 3/0282 141/23
4,950,237 A * 8/1990 Henault ..... B65D 81/3211 222/129
(Continued)

FOREIGN PATENT DOCUMENTS

KR 10-2011-0043388 4/2011
KR 20-0454099 Y1 4/2011
(Continued)

OTHER PUBLICATIONS

PCT/KR/2014/006042 Written Opinion English Translation (Year: 2014).*
KR101270341 Google EnglishTranslation (Year: 2013).*

*Primary Examiner* — Brian R Gordon
(74) *Attorney, Agent, or Firm* — Heedong Chae; Lucem, PC

(57) ABSTRACT

In an apparatus for automatically filling a pipette according to the present invention, only a predetermined air is supplied to a pipette assembly to which a substance is discharged, even if an excessive operation force is applied by a user, so it is possible to prevent a waste of the substance being unnecessarily discharged.

14 Claims, 37 Drawing Sheets

(51) Int. Cl.

| | |
|---|---|
| ***A45D 34/00*** | (2006.01) |
| ***A45D 34/04*** | (2006.01) |
| ***B05B 11/00*** | (2006.01) |

(56) References Cited

U.S. PATENT DOCUMENTS

| | | | | |
|---|---|---|---|---|
| 5,813,571 | A * | 9/1998 | Gaucher | B05B 11/0043 222/105 |
| 5,918,778 | A * | 7/1999 | Schultz | B05B 11/0016 222/321.1 |
| 2014/0346195 | A1* | 11/2014 | Doulin | B05B 11/0067 222/207 |
| 2015/0144663 | A1* | 5/2015 | Noel | A45D 34/00 222/383.1 |

FOREIGN PATENT DOCUMENTS

| | | |
|---|---|---|
| KR | 10-1162644 B1 | 7/2012 |
| KR | 10-1202092 61 | 11/2012 |
| KR | 10-1270347 B1 | 5/2013 |
| KR | 10-1308844 | 9/2013 |

* cited by examiner

APPARATUS FOR AUTOMATICALLY FILLING PIPETTE

CROSS-REFERENCE TO RELATED APPLICATION

This application claims the benefit of Korean Application Nos. 10-2013-0096697 filed on Aug. 14, 2013 and 10-2014-0017771 filed on Feb. 17, 2014 with the Korean Intellectual Property Office, the disclosure of which is incorporated herein by reference.

DESCRIPTION

Technical Field

The present invention relates to an apparatus for automatically filling a pipette, and more particularly, an apparatus for automatically filling a pipette that can discharge a substance in a pipette in a fixed amount.

Background Art

In order to use liquid-state substances such as make-up that is preferably used accurately by a predetermined small amount at a time such as eye cream, the substances were generally independently packed in a predetermined amount to be used each time in capsules and the like in the related art. However, even though substances are independently packed, a relatively large amount of the substances remain in the capsules after users use the substances, so it is considerably inefficient. However, even though substances are independently packed, a relatively large amount of the substances remain in the capsules after users use the substances, so it is considerably inefficient.

In order to overcome this problem in the individual packing, a configuration that dispenses a substance at each time of use, using a dispensing unit having the configuration of a push pump or a dispensing unit having the structure of a common pipette or a syringe after the substance is put in a container has been proposed.

However, according to a dispensing unit such as a common pipette, the amount of substance sucked and dispensed is different in accordance with the degree of pressing a push unit made of rubber by a user, so it is impossible or very difficult to dispense accurately the same amount of substance every time of using it.

Further, according to a dispensing unit having the configuration of a syringe, it is used generally for a very small amount around 1 ml, so there is a problem with a configuration in that it is required to make the diameter of a syringe very small or make the stroke of a piston very small and it is also required to suck a substance by pulling the piston of a syringe and then push back the piston of the syringe in order to dispense the substance, so it is very troublesome to use this type of dispensing unit.

Meanwhile, according to a dispensing unit having the configuration of a push pump, although there is the advantage that a predetermined amount of substance can be dispensed every time a button is simply pressed, the entire configuration includes not only the structure for the inside and outside of a pump, but a button, an inlet, an outlet, a spring, a valve, and the like, so it is complicated. Further, since a push pump is usually disposed at the top of a container, a suction tube is generally used to suck a substance, but even if a substance remains in a container, the substance cannot be dispensed in some cases, depending on the position of the suction tube.

PRIOR ART DOCUMENT

Patent Document (Patent Document 1) Korean Patent No. 10-1083262
(Patent Document 2) Korean Patent No. 10-1239027

DISCLOSURE

Technical Problem

The present invention relates to an apparatus for automatically filling a pipette that can discharge a substance in a pipette in a fixed amount.

Technical Solution

The present invention provides an apparatus for automatically filling a pipette that has a thread 11 and is thread-fastened to a container 10 keeping a substance. The apparatus includes: a pipette assembly 20 that is sucked and thus filled with the substance; a pumping assembly 30 that is disposed over the pipette assembly 20, relatively moves to the pipette assembly 20, and provides a pressure change of an pumping space 81 to the pipette assembly 20; a bellows that is made of an elastic material and connects the pipette assembly 20 and the pumping assembly 30 that are relatively moved to each other; and a housing 50 that has a thread 51 on the inner side that is coupled to the thread 11 of the container 10 and to which the pumping assembly 30 is fixed.

A discharge channel through which discharged air flows to the pipette assembly 20 and an intake channel through which external air flows into the pumping space 81 of the pumping assembly 30 may be formed in the pumping assembly 30.

The pumping assembly 30 may include: a discharge hole 65 that connects the pumping space 81 and a pipette assembly 20; an intake hole 67 connected with the pumping space 81 so that external air flows into the pumping space 81; a discharge diaphragm 175 that seals the discharge hole 65 and opens the discharge hole 65 sealed by a pressure difference when positive pressure is generated in the pumping space 81; and an intake diaphragm 188 that seals the intake hole 67 and opens the intake hole 67 sealed by a pressure difference when negative pressure is generated in the pumping space 67.

The pumping assembly 30 may include: a pumping mount 60 that is fixed to the housing 50, to which the bellows is coupled, and that has the discharge hole 65 and the intake hole 67; a pump 180 that has the pumping space 81 therein and has an intake diaphragm 188 disposed between the pumping mount 60 and the housing 50 to close the intake hole 67 and opening the intake hole 67 by a pressure difference only when negative pressure is generated in the pumping space 81; and a check valve member 170 that is disposed in the pumping mount 60 to close the discharge hole 65 and opens the discharge hole 65 only when positive pressure is generated in the pumping space 81 such that air in the pumping space 81 flow to the bellows.

The pumping mount 60 may include: a pumping body 62 that is coupled and fixed to the housing 50; a coupling hole 63 that is formed in the pumping body 62 and through which the check valve member 170 is disposed; a discharge hole 65 that is formed in the pumping body 62, is closed by the check valve member 170, and is opened toward the bellows 140 only when positive pressure is generated in the pumping space 81; a pumping mount fixing portion 66 where the bellows is coupled and fixed; the intake hole 67 that is formed in the pumping body 62, is closed by the pump 180, and is opened toward the inside of the pumping space 81 only when negative pressure is generated in the pumping space 81; and a pump mount support 68 that separates the discharge hole 65 and the intake hole 67 and is brought in close contact with the pump 180 in an assembly.

The pumping assembly 30 may include: a discharge channel for allowing discharged air to flow to the pipette assembly 20; an intake channel for allowing external air to flow to the pumping space 81 of the pumping assembly 30; a discharge check valve 70 opening/closing the discharge channel in accordance with a pressure difference of the pumping assembly; and an intake check valve 90 opening/closing the intake channel in accordance with a pressure difference of the pumping assembly.

The pumping assembly 30 may include: a pumping mount 60 that is coupled and fixed to the housing 50 in close contact with the bellow; a pump 80 that is made of a flexible material having elasticity, keeps air in the pumping space 81 formed therein, is disposed between the pumping mount 60 and the housing 50, and provides compressed air to the bellows through the pumping mount 60; a discharge check valve 70 that is disposed in the pumping mount 60, allows air from flowing to the pipette assembly 20 through the pumping mount 60 when the pressure inside the pump 80 is positive pressure, and prevents air flowing to the pump 80 from the pipette assembly 20 when the pressure inside the pump 80 is negative pressure; and an intake check valve 90 that is disposed in the pumping mount 60, allows external air to flow into the pump 80 through the pumping mount 60 when the pressure inside the pump 80 is negative pressure, and prevents air in the pump 80 from being discharged when the pressure inside the pump 80 is positive pressure.

The pumping assembly 30 may include: a pumping mount 60 that is fixed to the housing 50, to which the bellows is coupled, and that has the discharge hole 65 and the intake hole 67; a pump 80 that has the pumping space 81 therein and has an intake diaphragm 94 disposed between the pumping mount 60 and the housing 50 to close the intake hole 67 and opening the intake hole 67 by a pressure difference only when negative pressure is generated in the pumping space 81; and a discharge check valve 70 that is disposed in the pumping mount 60 to close the discharge hole 65 and opens the discharge hole 65 only when positive pressure is generated in the pumping space 81 such that air in the pumping space 81 flow to the bellows.

The pumping mount 60 may include: a pumping body 62 that is disposed between the housing 50 and the pump 80; a discharge hole 65 that is formed in the pumping body 62, is closed by the discharge check valve 70, and is opened toward the bellows only when positive pressure is generated in the pump 80; a pumping mount fixing portion 66 where the bellows is coupled and fixed; an intake hole 67 that is formed in the pumping body 62, is closed by the intake check valve 90, and is opened toward the inside of the pump 80 only when negative pressure is generated in the pump 80; and a pump mount support 68 that separates the discharge hole 65 and the intake hole 67 and is brought in close contact with the pump 80 in an assembly.

When the container 10 is thread-fastened, the bellows may contract by relatively moving toward the pipette assembly 20 and the pumping assembly 30, and when the container 10 is separated, the bellows may expand by relatively moving away from the pipette assembly 20 and the pumping assembly 30.

When the bellows expands, the substance in the container 10 may be sucked into the pipette assembly 20.

Advantageous Effects

According to an apparatus for automatically filling a pipette of the present invention, a pipette assembly is filled with a substance when being separated from a container, so a user do not have to perform specific operation to fill a pipette with a substance.

Further, in the apparatus according to the present invention, when a user presses the pump 80, a discharge channel for air is formed to the pipette assembly 20, and when the pump 80 is returned, an intake channel for sucking external air into the pumping space 81 is formed, so even if the pump 80 is repeatedly operated, only a fixed amount of substance is discharged.

Further, in the apparatus according to the present invention, when a user presses the pump 180, a discharge channel ① for air is formed to the pipette assembly 20, and when the pump 180 is returned, an intake channel ② for sucking external air into the pumping space 81 is formed, so even if the pump 180 is repeatedly operated, only a fixed amount of substance is discharged.

Further, in the apparatus for automatically filling a pipette according to the present invention, only a predetermined air is supplied to a pipette assembly to which a substance is discharged, even if an excessive operation force is applied by a user, so it is possible to prevent a waste of the substance being unnecessarily discharged.

MODE FOR INVENTION

Figure 1:
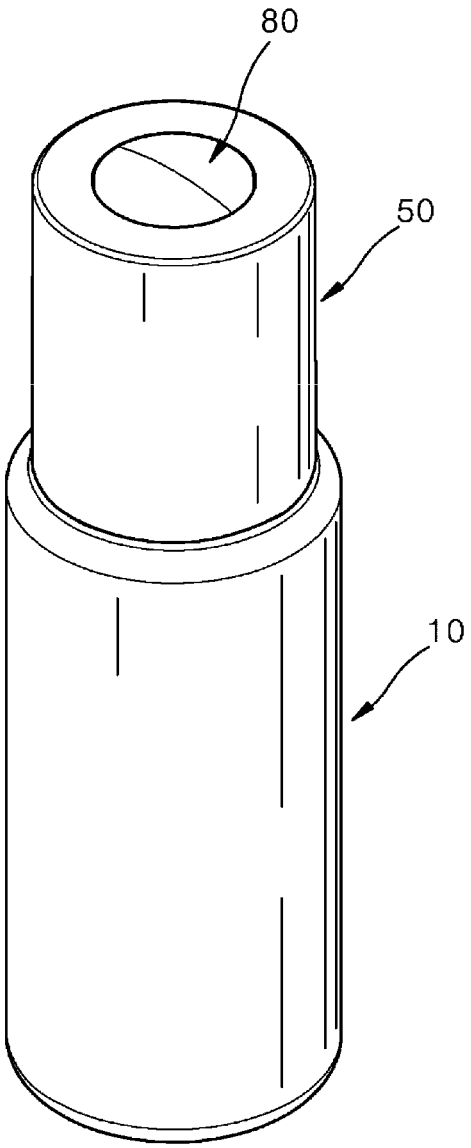
FIG. 1 is a perspective view of an apparatus for automatically filling a pipette according to a first embodiment of the present invention.

Hereinafter, the present invention will be described in detail with reference to the accompanying drawings.

In describing the present invention, well-known functions or constructions will not be described in detail since they may unnecessarily obscure the understanding of the present invention. It should be noted that even if the same terms are used but they indicate different components, they are not given the same reference numerals.

The terms described hereafter are terms defined in consideration of the functions in the present disclosure and may be change in accordance with the intention of a user such as an experimenter and a measurer and a custom, so the definition should be based on the entire description of the present disclosure.

Terms used in the specification, 'first', 'second', and the like, may be used to describe various components, but the components are not to be construed as being limited to the terms. The terms are used to distinguish one component from another component. For example, the 'first' component may be named the 'second' component, and vice versa, without departing from the scope of the present invention. The term 'and/or' includes a combination of a plurality of items or any one of a plurality of terms.

Terms used in the present specification are used only in order to describe specific exemplary embodiments rather than limiting the present invention. As used herein, the singular forms are intended to include the plural forms as well, unless the context clearly indicates otherwise.

Unless otherwise defined, all terms including technical and scientific terms used herein have the same meaning as commonly understood by one of ordinary skill in the art to which the present invention belongs. It must be understood that the terms defined by the dictionary are identical with the meanings within the context of the related art, and they should not be ideally or excessively formally defined unless the context clearly dictates otherwise.

Further, unless explicitly described otherwise, "comprising" any components will be understood to imply the inclusion of other components rather than the exclusion of any other components.

Figure 2:
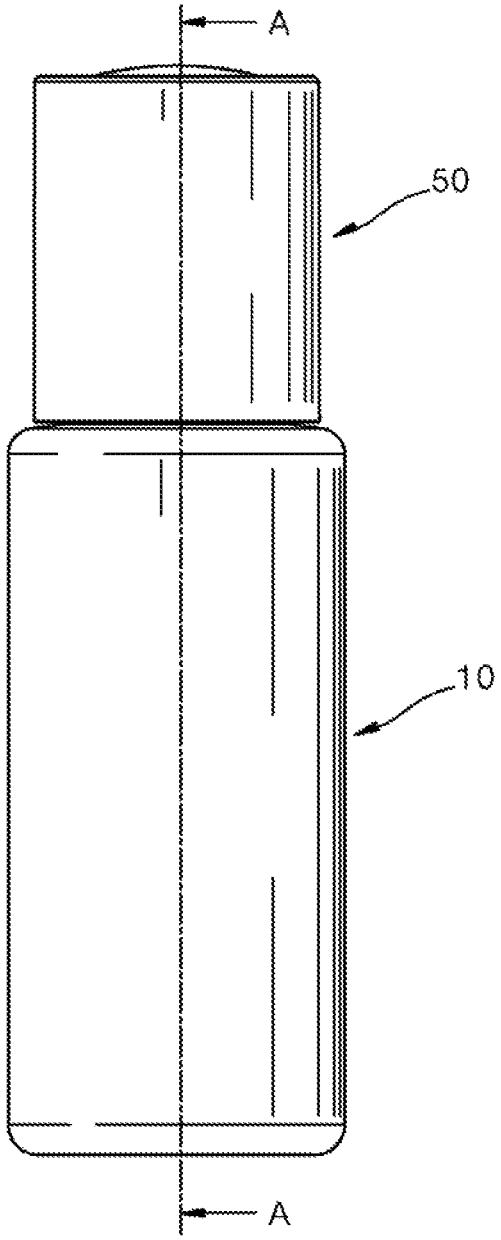
FIG. 2 is a front view of FIG. 1.
Figure 3:
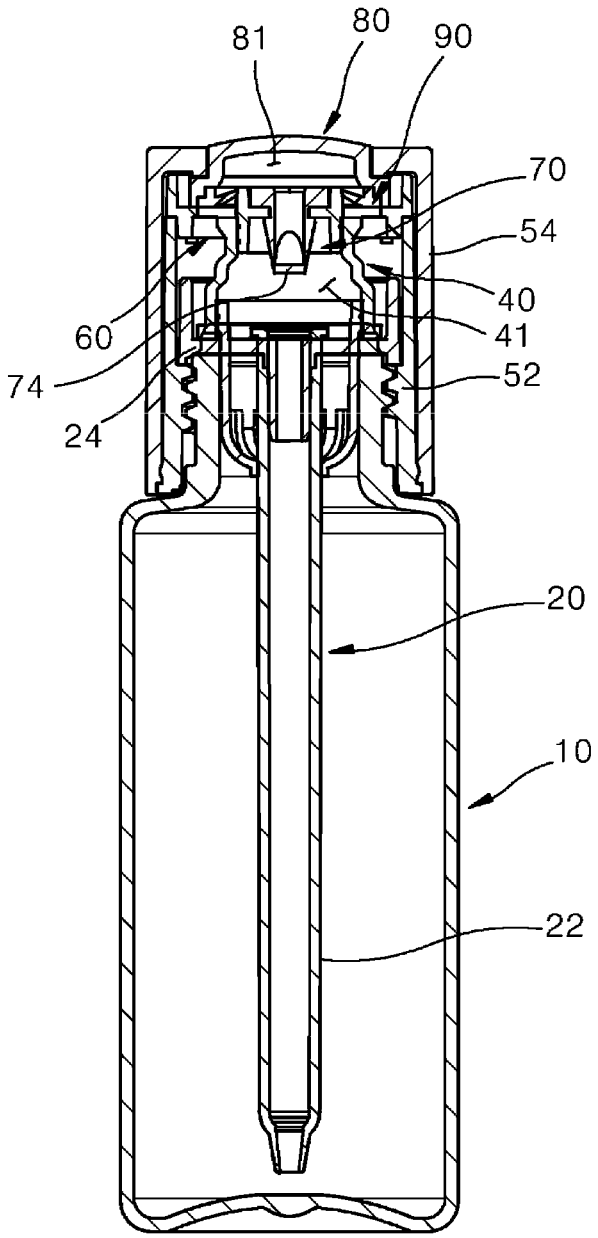
FIG. 3 is a cross-sectional view taken along line A-A of FIG. 2.
Figure 4:
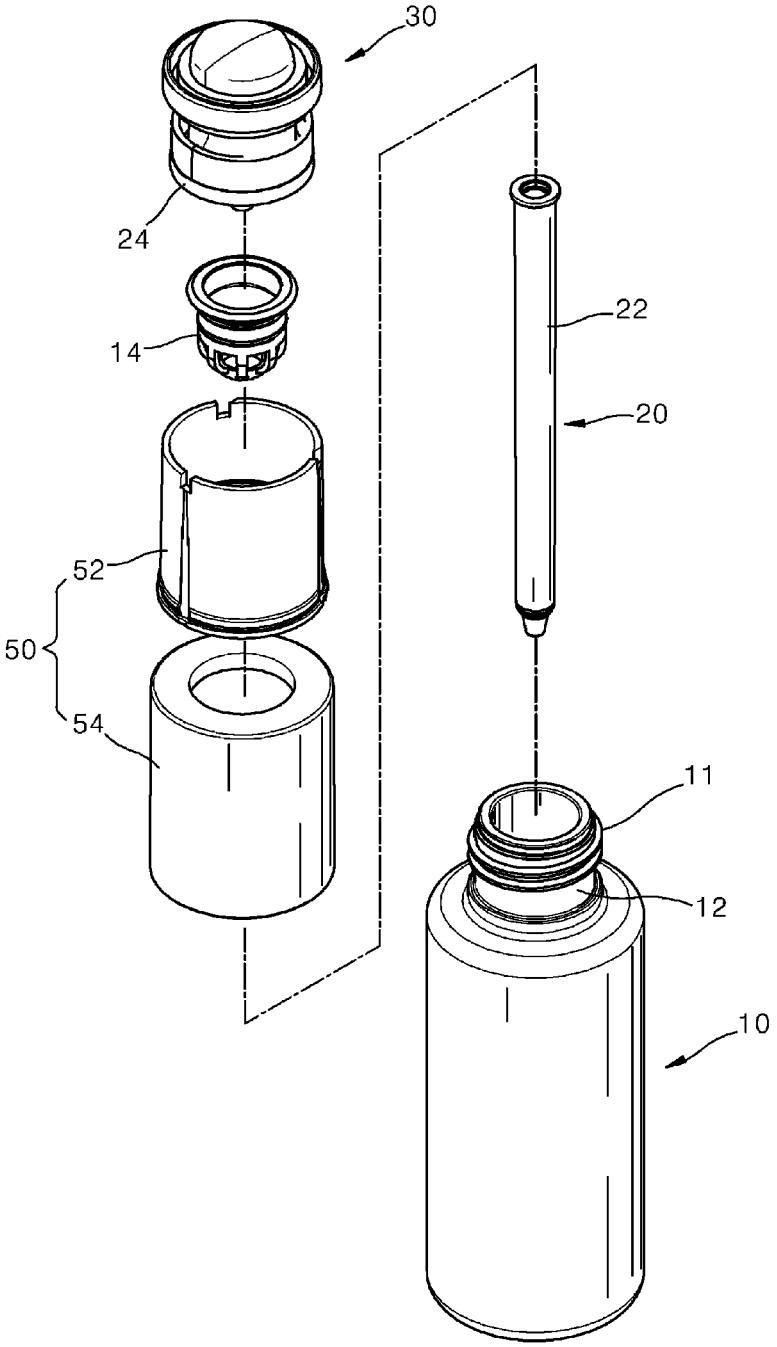
FIG. 4 is an exploded perspective view of FIG. 1.
Figure 5:
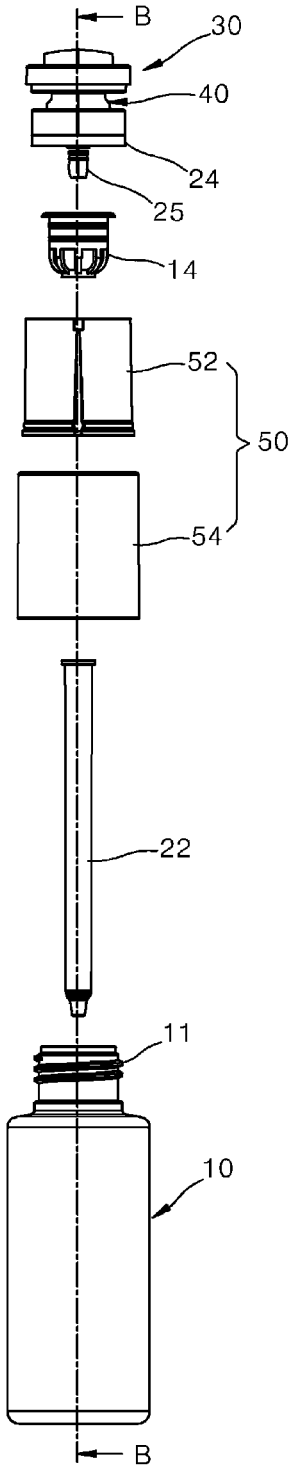
FIG. 5 is a front view of FIG. 4.
Figure 6:
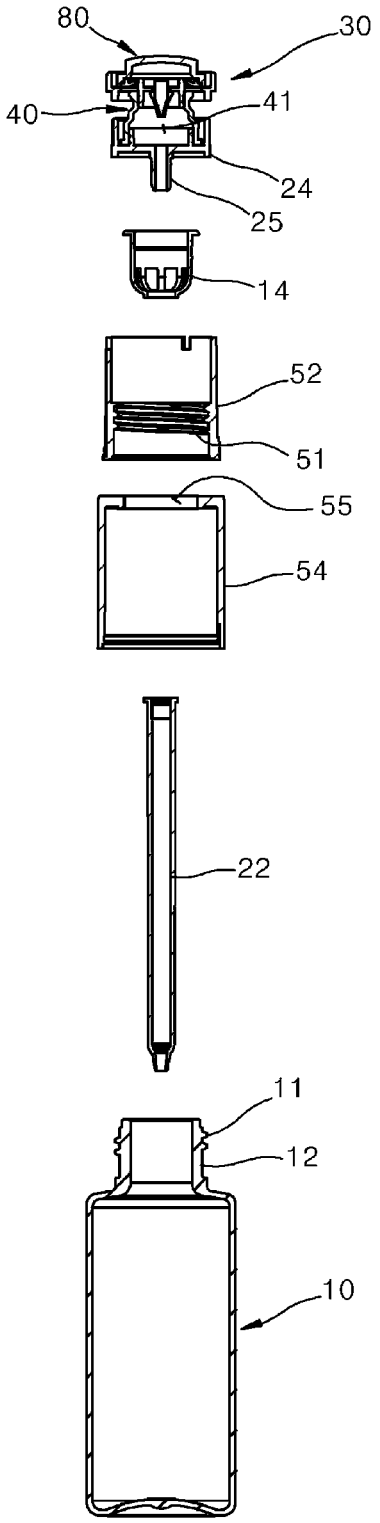
FIG. 6 is a cross-sectional view taken along the line B-B of FIG. 5.
Figure 7:
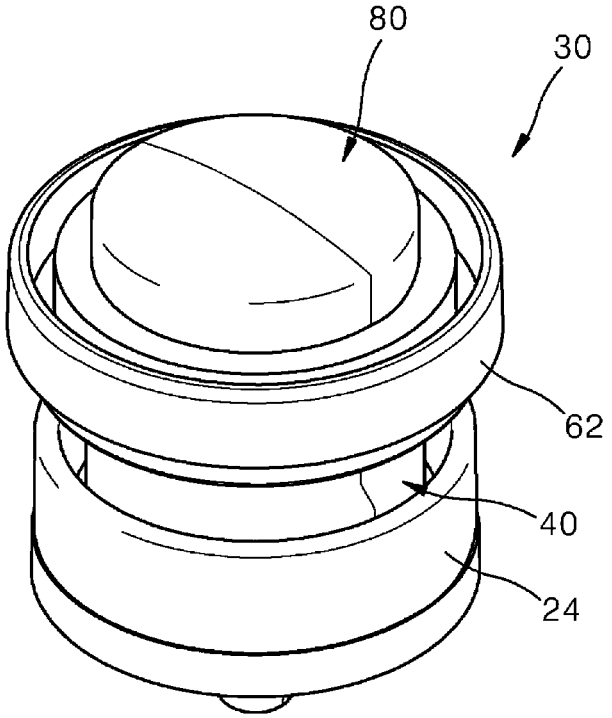
FIG. 7 is a perspective view of a pumping assembly illustrated in FIG. 4.
Figure 8:
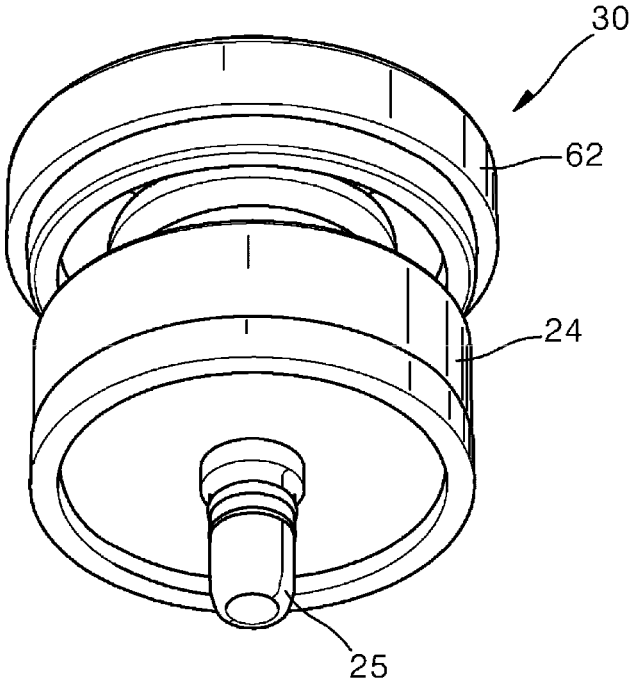
FIG. 8 is a bottom perspective view of FIG. 7.
Figure 9:
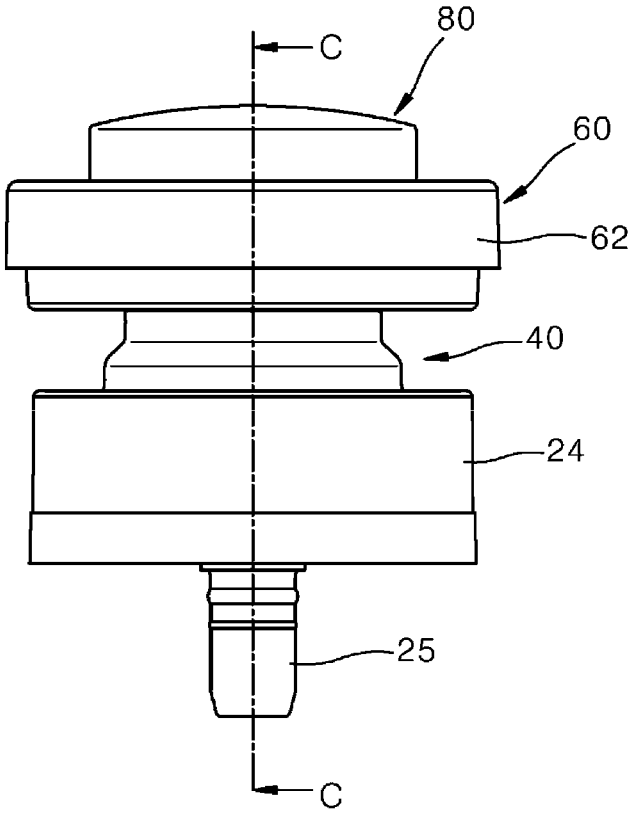
FIG. 9 is a front view of FIG. 7.
Figure 10:
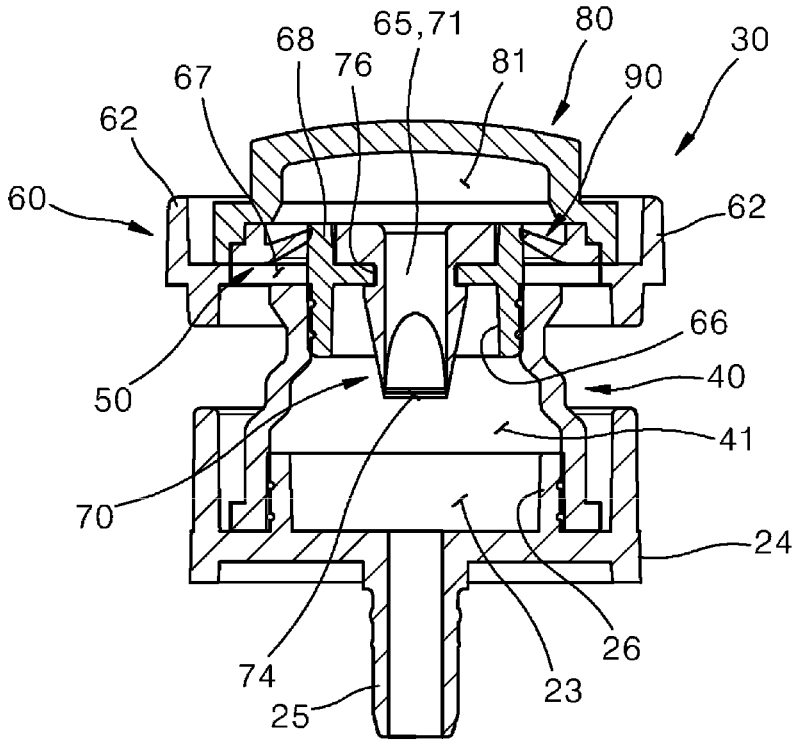
FIG. 10 is a cross-sectional view taken along the line C-C of FIG. 9.
Figure 11:
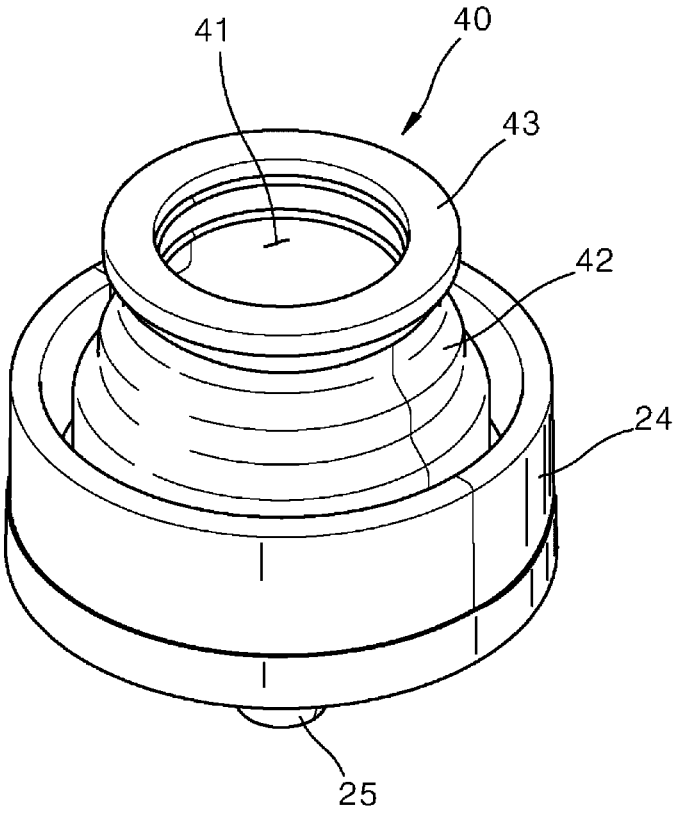
FIG. 11 is a perspective view illustrating an assembly of a bellows and a pipette mount illustrated in FIG. 7.
Figure 12:
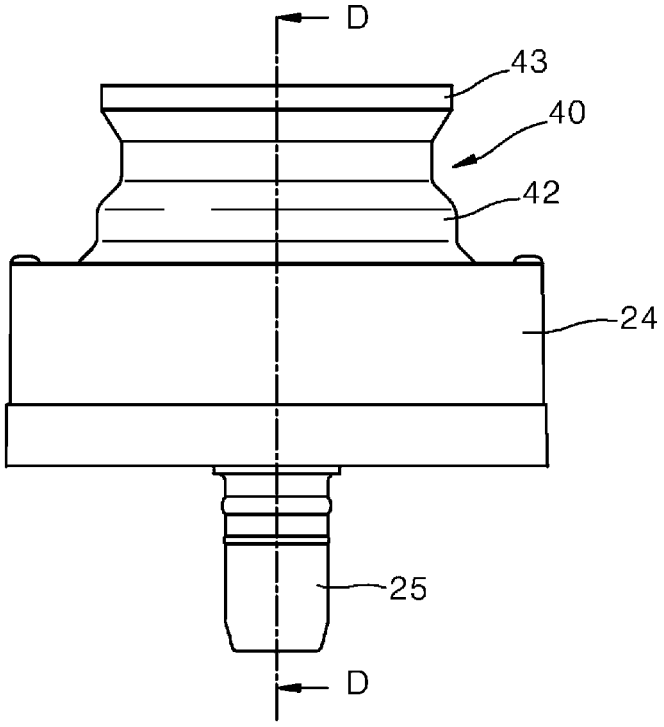
FIG. 12 is a front view of FIG. 11.
Figure 13:
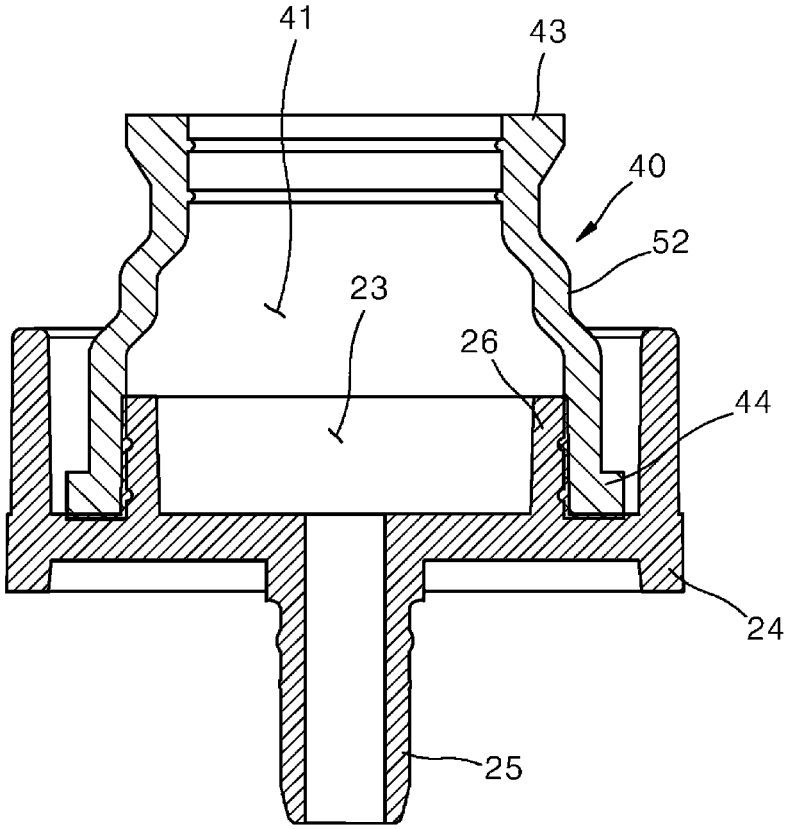
FIG. 13 is a cross-sectional view taken along line D-D of FIG. 12.
Figure 14:
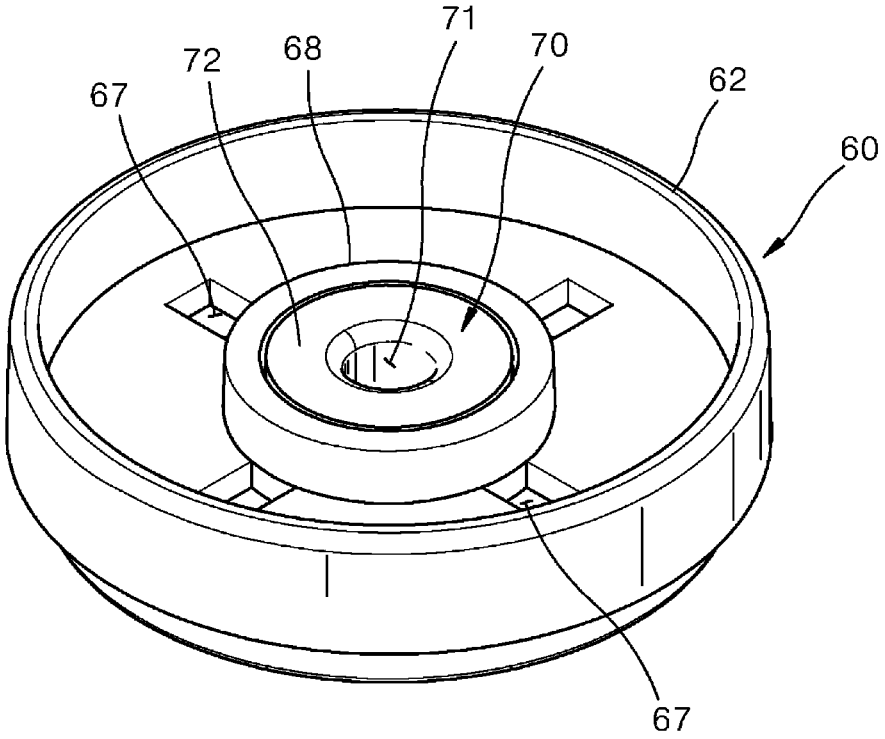
FIG. 14 is a perspective view illustrating an assembly of a pumping mount and a discharge check valve illustrated in FIG. 7.
Figure 15:
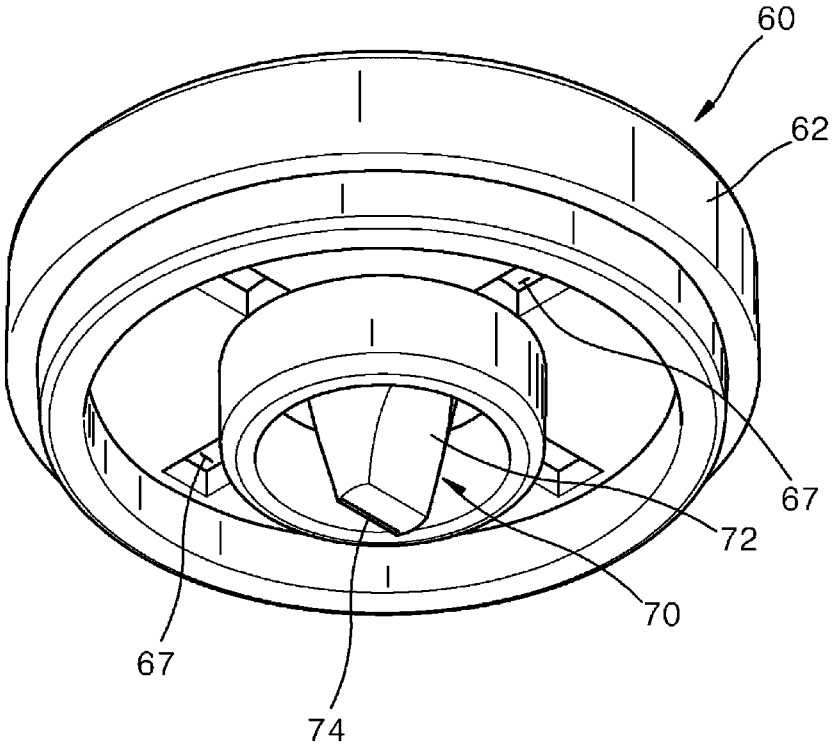
FIG. 15 is a bottom perspective view of FIG. 14.
Figure 16:
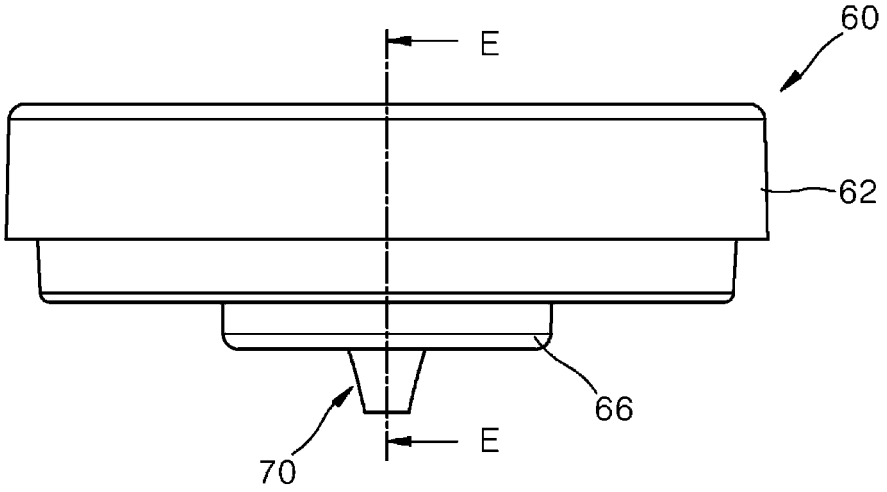
FIG. 16 is a front view of FIG. 14.
Figure 17:
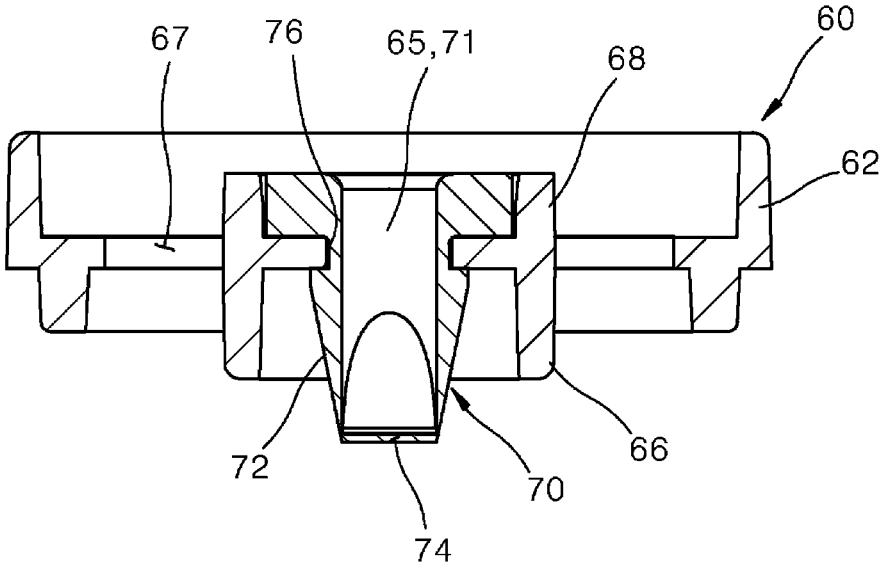
FIG. 17 is a cross-sectional view taken along the line E-E of FIG. 16.
Figure 18:
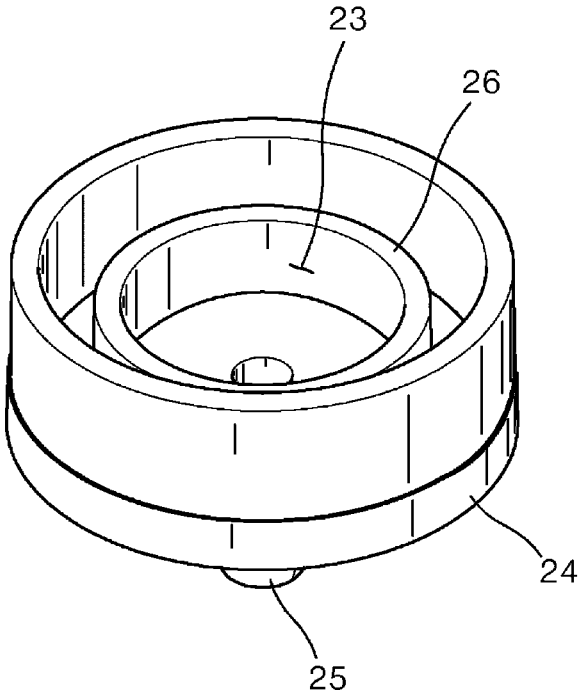
FIG. 18 is a perspective view of a pipette mount illustrated in FIG. 7.
Figure 19:
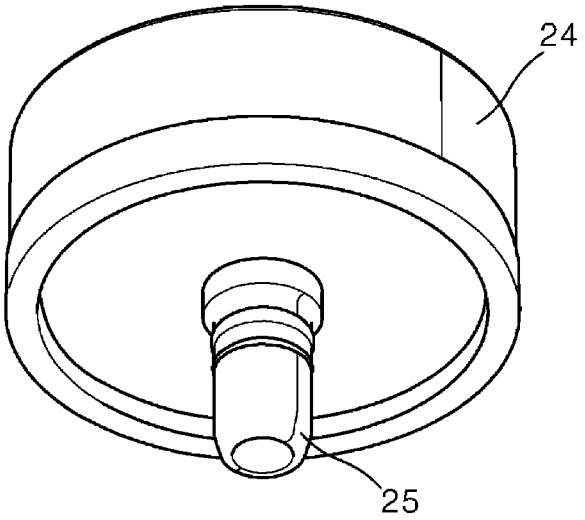
FIG. 19 is a bottom perspective view of FIG. 18.
Figure 20:
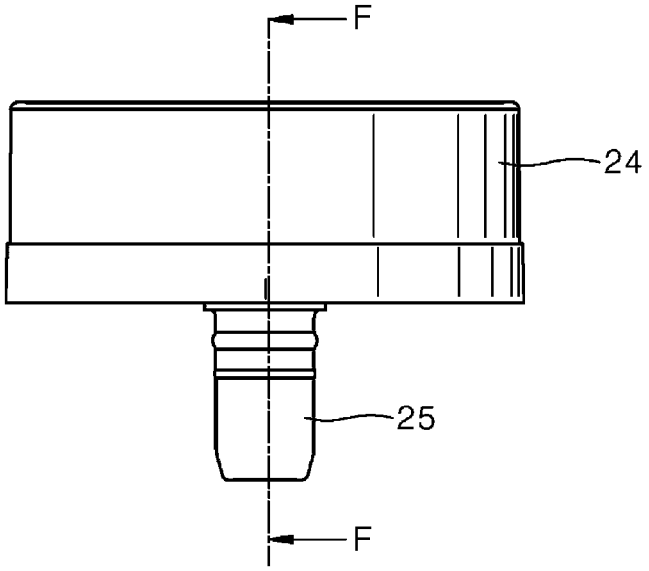
FIG. 20 is a front view of FIG. 18.
Figure 21:
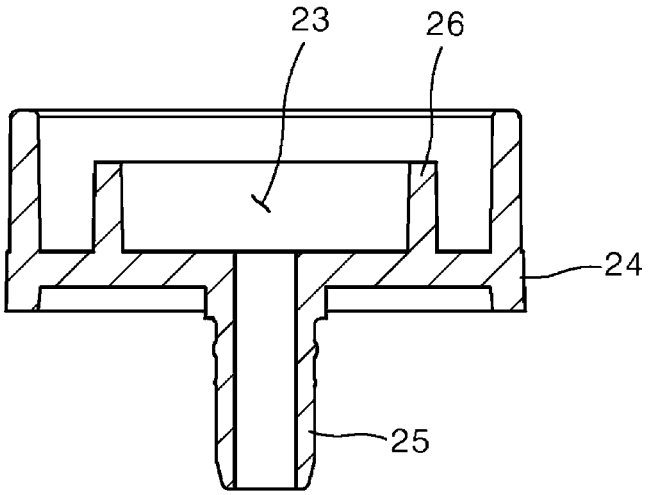
FIG. 21 is a cross-sectional view taken along line F-F of FIG. 20.
Figure 22:
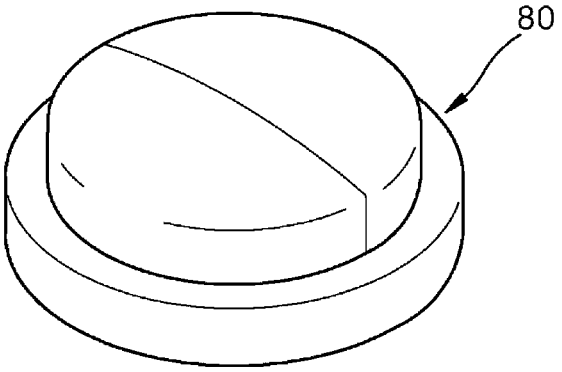
FIG. 22 is a perspective view illustrating an assembly of a pump and an intake check valve illustrated in FIG. 7.
Figure 23:
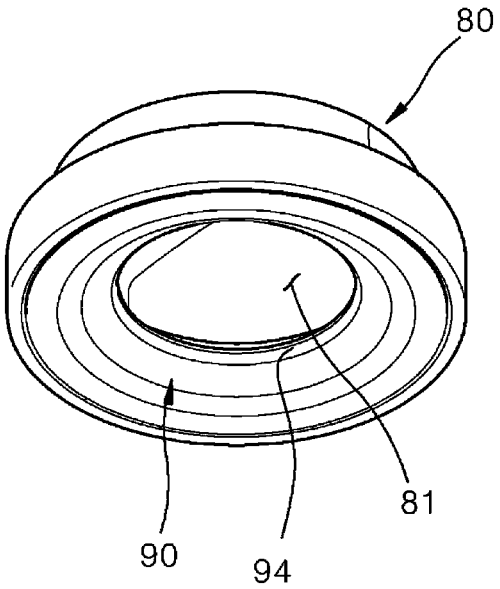
FIG. 23 is a bottom perspective view of FIG. 22.
Figure 24:
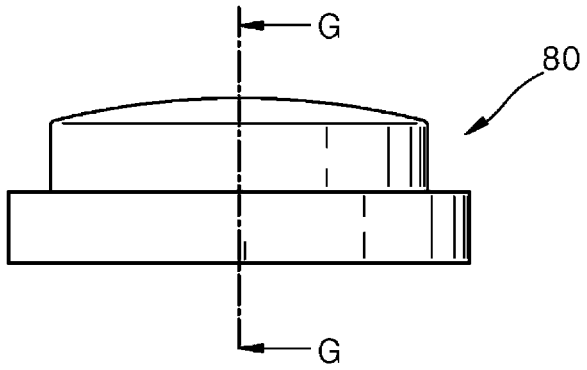
FIG. 24 is a front view of FIG. 22.
Figure 25:
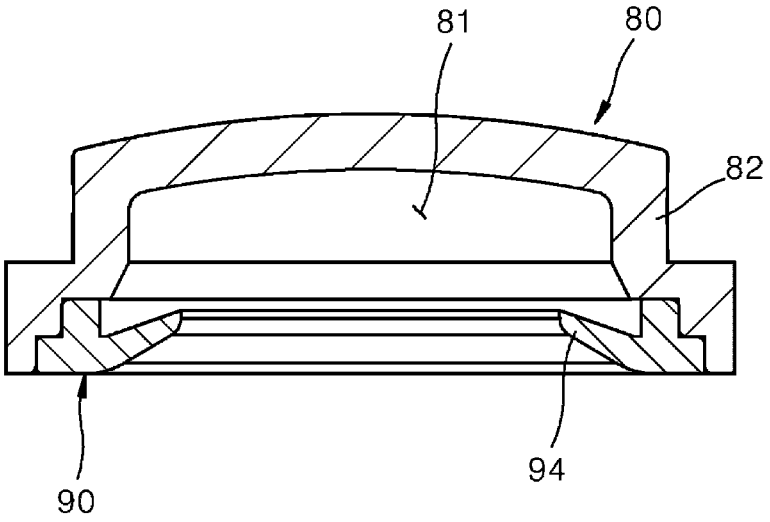
FIG. 25 is a cross-sectional view taken along line G-G of FIG. 24.

FIG. 1 is a perspective view of an apparatus for automatically filling a pipette according to a first embodiment of the present invention. FIG. 2 is a front view of FIG. 1, FIG. 3 is a cross-sectional view taken along line A-A of FIG. 2, FIG. 4 is an exploded perspective view of FIG. 1, FIG. 5 is a front view of FIG. 4, FIG. 6 is a cross-sectional view taken along the line B-B of FIG. 5, FIG. 7 is a perspective view of a pumping assembly illustrated in FIG. 4, FIG. 8 is a bottom perspective view of FIG. 7, FIG. 9 is a front view of FIG. 7, FIG. 10 is a cross-sectional view taken along the line C-C of FIG. 9, FIG. 11 is a perspective view illustrating an assembly of a bellows and a pipette mount illustrated in FIG. 7, FIG. 12 is a front view of FIG. 11, FIG. 13 is a cross-sectional view taken along line D-D of FIG. 12, FIG. 14 is a perspective view illustrating an assembly of a pumping mount and a discharge check valve illustrated in FIG. 7, FIG. 15 is a bottom perspective view of FIG. 14, FIG. 16 is a front view of FIG. 14, FIG. 17 is a cross-sectional view taken along the line E-E of FIG. 16, FIG. 18 is a perspective view of a pipette mount illustrated in FIG. 7, FIG. 19 is a bottom perspective view of FIG. 18, FIG. 20 is a front view of FIG. 18, FIG. 21 is a cross-sectional view taken along line F-F of FIG. 20, FIG. 22 is a perspective view illustrating an assembly of a pump and an intake check valve illustrated in FIG. 7, FIG. 23 is a bottom perspective view of FIG. 22, FIG. 24 is a front view of FIG. 22, and FIG. 25 is a cross-sectional view taken along line G-G of FIG. 24.

As illustrated in the figures, an apparatus for automatically filling a pipette according to an embodiment of the present invention includes: a pipette assembly 20 that has a thread 11 on the outer side to be coupled to a container 10 for keeping an substance and is sucked and thus filled with the substance; a pumping assembly 30 that is disposed over the pipette assembly 20, relatively moves toward the pipette assembly 20, and provide a pressure change to the pipette assembly 20 by receiving an operation force from a user; a bellows 40 that is made of a flexible material, connects the pipette assembly 20 and the pumping assembly 30, and is compressed or expanded when the pumping assembly 30 relatively moves; and a housing 50 that receives the pipette assembly 20, the pumping assembly 30, and the bellows 40, and has a thread 51 on the inner side to be coupled to the thread 11 of the container 10.

The container 10 has a container inlet 12 at the top and has the thread 11 on the outer side of the container inlet 12 and a viscous substance is kept in the container.

A wiper 14 is disposed inside the container inlet 12.

The pipette assembly 20 includes a pipette 22 disposed inside the container 10 and sucking and keeping the substance and a pipette mount 23 having a mount hole 24 for providing pressure to the pipette 22 and fixing the pipette 22.

The pipette 22 is inserted in the container 10 through the wiper 14 in the container inlet 12 and the wiper 14 prevents a substance from being unnecessarily taken out of the container 10 by wiping the substance on the outer side of the pipette 22.

The mount hole 23 is vertically formed through the pipette mount 24, so the pipette mount 24 can provide a pressure change into the pipette 22 through the mount hole 23.

Further, the pipette mount 24 has a pipette fixing portion 25 protruding downward from the bottom and the pipette 22 is fitted on the pipette fixing portion 25.

Further, the pipette mount 24 has a bellows fixing portion 26 protruding upward and the bellows 40 is fitted on the bellow fixing portion 26, thereby sealing the container by preventing external air from flowing inside.

Herein, the bellows fixing portion 26 is formed around the mount hole 23, and when the bellows 40 is combined, the inside of the bellows 40 and the mount hole 23 communicate with each other.

The bellows 40 is made of a flexible material having elasticity and includes a bellows body 42 having a compression space 41 therein and bellows fixing portions 43 and 44 on the top and the bottom of the bellows body 42, respectively.

Herein, the bellows body 42 may have a plurality of wrinkles or steps and transmits pressure to the pipette 22 by changing the pressure therein through extension and contraction.

The pumping assembly 30 includes: a pumping mount 60 that is coupled and fixed to the housing 50 in close contact with the bellows 40; a pump 80 that is made of a flexible material having elasticity, keeps air therein, is disposed between the pumping mount 60 and the housing 50, and provides compressed air to the bellows 40 through the pumping mount 60; a discharge check valve 70 that is disposed in the pumping mount 60, allows air from flowing to the pipette assembly 20 through the pumping mount 60 when the pressure inside the pump 80 is positive pressure, and prevents air flowing to the pump 80 from the pipette assembly 20 when the pressure inside the pump 80 is negative pressure; and an intake check valve 90 that is disposed in the pumping mount 60, allows external air to flow into the pump 80 through the pumping mount 60 when the pressure inside the pump 80 is negative pressure, and prevents air in the pump 80 from being discharged when the pressure inside the pump 80 is positive pressure.

The discharge check valve 90 is disposed inside the pumping mount 60, the discharge check valve 70 allows air to flow only to the bellows 40 from the pump 80 while preventing air from flowing in the opposite direction, and provides pressure to the pipette assembly 20 when air is discharged so that the substance in the pipette assembly 20 is discharged in a fixed amount.

To this end, the pumping mount 60 has a discharge channel for discharging air from the pump 80 to the pipette assembly 20 and an intake channel for sucking air into the pump 80 from the outside of the pumping assembly, in which the channels are separated.

The pumping mount 60 includes a pumping body 62, a discharge hole 65 that is formed in the pumping body 62, is closed by the discharge check valve 70, and is opened toward the bellows 40 only when the pressure inside the pump 80 is positive pressure, a pumping mount fixing portion 66 that is coupled and fixed to the bellows 40, an intake hole 67 that is formed in the pumping body 62, is closed by the intake check valve 90 and is opened toward the inside of the pump 80 only when the pressure inside the pump 80 is negative pressure, and a pump mount support 68 that separates the discharge hole 65 and the intake hole 67 and that is brought in close contact with the pump 80 in the assembly.

The discharge hole 65 is a discharge channel for allowing air to flow only to the pipette assembly 20 and the intake hole 67 is an intake channel allowing air to flow only into the pump 80.

In this embodiment, the discharge check valve 70 is disposed through the discharge hole 65 and the intake check valve 90 is disposed in the intake hole 67.

The pumping mount fixing portion 66 is fitted in the bellows fixing portion 43.

In this embodiment, the discharge hole 65 is formed at the axial center of the pumping mount 60 and it is fitted in the pumping body 62 through the discharge hole 65.

The discharge check valve 70 disposed in the discharge hole 65 includes a discharge check body 72 that is coupled and fixed to the pumping mount 60, a discharge diaphragm 74 that is formed at the lower end of the discharge check body 72 and is elastically deformed to discharge air to the pipette assembly 20 only when the pressure inside the pump 80 is positive pressure, and a discharge check fixing groove 76 that is recessed on the discharge check body 72 and fixed to the pumping mount 60.

The discharge check valve 70 is formed a pointed wedge shape at the lower end and the discharge diaphragm 74 is formed at the lower end. The discharge diaphragm 74 is made of a thin elastic material and the material is deformed by a pressure change in the pump 80.

The intake check valve 90 is formed in a ring shape and coupled to the lower portion of the pump 80 and the thin intake diaphragm 84 is formed around the inner edge of the intake check valve.

Herein, the intake diaphragm 94 is made of a material that is elastically deformed by a pressure change, with the inner end facing up, and is in close contact with the pump mount support 68.

Accordingly, when the pressure inside the pump 80 is positive pressure, the intake diaphragm 94 is elastically deformed and further comes in close contact with the pump mount support 68, and when the pressure inside the pump 80 is negative pressure, the intake diaphragm 94 is deformed and air flows between the intake diaphragm 94 and the pump mount support 68.

Meanwhile, the intake check valve 90 seals the intake hole 67 of the pumping mount 60 when being combined with the pump 80.

The intake hole 67 is disposed radially outside the discharge hole 65 in close contact with the lower end of the pump 80 over the pumping mount 60, and four intake holes 67 are formed at 90 degrees.

Herein, only when the pressure inside the pump 80 is negative pressure, air is sucked into the pump 80 through the intake holes 67 by a pressure difference.

Accordingly, in this embodiment, it is preferable that the check valve 60 is made of elastic synthetic resin to further seal the discharge hole 65 and the intake holes 67.

The pump 80 has a pumping space 81 therein.

The pump body 82 is made of elastic flexible synthetic resin and makes positive pressure inside the pumping space 81 to be deformed when it is pressed by an operation force from a user.

The housing 50 includes an inner housing 52 having a thread 51 to be thread-fastened to the container 10 and an outer housing 54 combined with the inner housing 52 and having a pump-through hole 55 to expose the pump 80 of the pump assembly 30.

The inner housing 52 and the outer housing 54 are integrated by coupling after assembling.

Further, the pumping mount 60 is fitted in the housing 50, and in this embodiment, it is fitted in between the inner housing 52 and the outer housing 54 and seated on the top of the inner housing 52.

In this embodiment, although the pumping mount 60 is fixed when the inner hosing 52 and the outer housing 54 are combined, it may be fixed to the housing 50 by a specific fastener, unlike this embodiment.

Operation of the apparatus according to the first embodiment of the present invention is described in detail with reference to the drawings.

First, the apparatus according to this embodiment, when it is coupled to the thread 11 of the container 10, the bellows 40 is compressed by the pipette assembly 20 moving toward the pumping assembly 30, and air in the compression space 41 is discharged into the container through the pipette 22 with the compression of the bellows 40.

Thereafter, when a user separates the apparatus from the container 10 by turning it, in the pipette assembly 20, the bellows 40 returns to the initial state and negative pressure is generated in the compression space 41, and the substance in the container 10 is sucked into the pipette 22 by the negative pressure.

That is, while the user separates the apparatus, the substance in the container 10 is sucked and thus filled into the apparatus.

Next, when a user wants to discharge the sucked substance, he/she presses the pump 80, and the pumping space 81 in the pump 80 is compressed by the operation force from the user.

Herein, since the pump 80 is in close contact with the pumping mount 60, the pumping space 81 of the pumping assembly 30 is sealed, but when it is pressed by the operation force from the user, the discharge diaphragm 74 is deformed and the air in the pumping space 81 is discharged to the pipette assembly 20.

Accordingly, when the pump 80 is pressed, the air in the pumping space 80 moves to the pipette assembly 20 and discharges a fixed amount of the substance in the pipette 22.

Further, the discharge diaphragm 74 is deformed only while air is discharged, and after the air is discharged, it is returned to the initial state by elasticity of the material and seals the pumping space 81.

In particular, even if the user increases the force pressing the pump 80, the air to be discharge is limited, so even if the operation force from the user is increased, the amount of discharged substance is limited, and accordingly, a waste of the substance can be prevented.

Next, even though the user release the pump 80, the discharge diaphragm 74 keeps the discharge hole 65 sealed, so air flow is not generated under the discharge diaphragm 74 and the substance in the pipette 22 can be prevented from being sucked upward again.

Herein, when the operation force applied to the pump 80 is removed, the pump 80 returns to the initial shape and negative pressure is generated in the pumping space 81, the intake diaphragm 94 is opened by the negative pressure, and external air flows into the pumping space 81 through the intake hole 67.

In the apparatus according to this embodiment, when a user presses the pump 80, a discharge channel for air is formed to the pipette assembly 20, and when the pump 80 is returned, an intake channel for sucking external air into the pumping space 81 is formed, so even if the pump 80 is repeatedly operated, only a fixed amount of substance is discharged.

Figure 26:
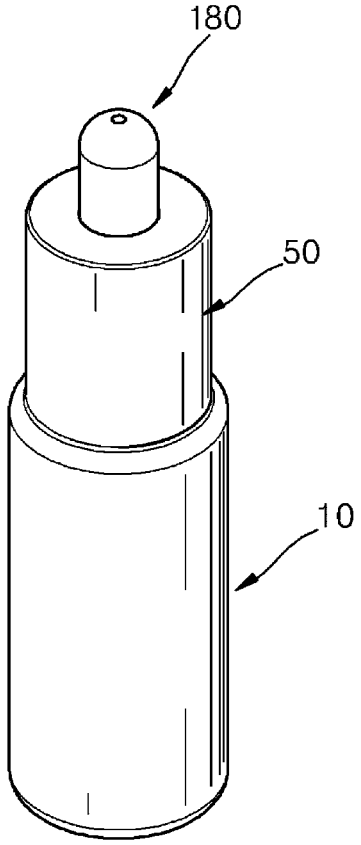
FIG. 26 is a perspective view of an apparatus for automatically filling a pipette according to a second embodiment of the present invention.
Figure 27:
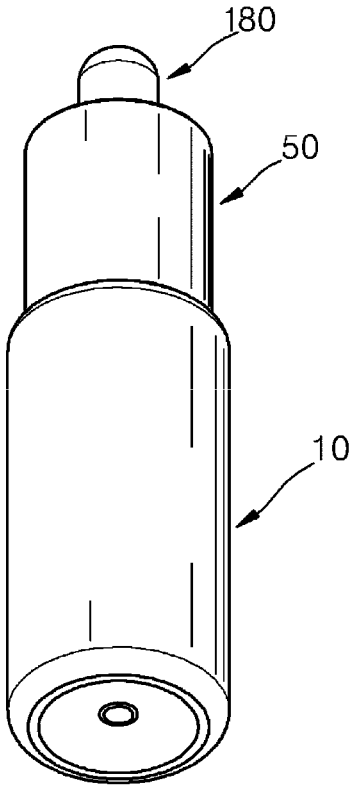
FIG. 27 is a perspective view the apparatus of FIG. 26, seen from under the apparatus.
Figure 28:
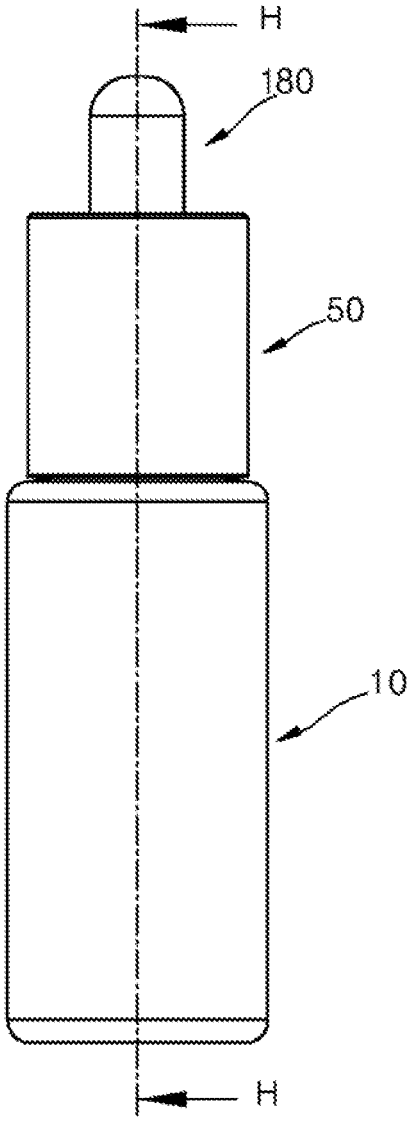
FIG. 28 is a front view of FIG. 26.
Figure 29:
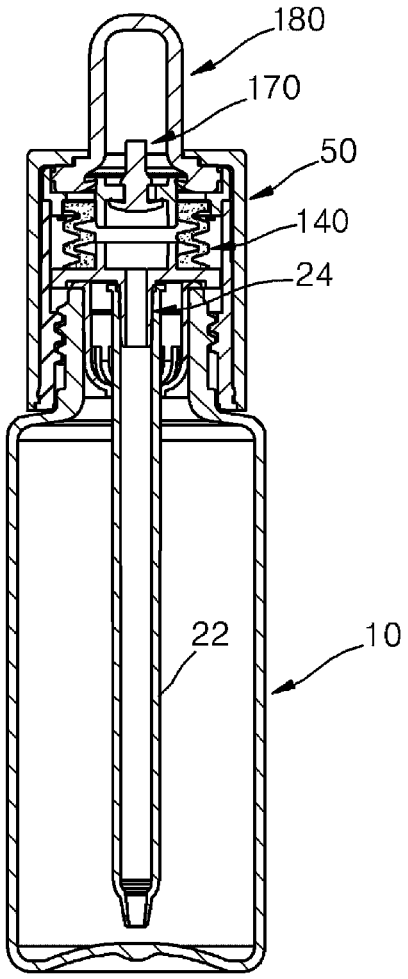
FIG. 29 is a cross-sectional view taken along line H-H of FIG. 28.
Figure 30:
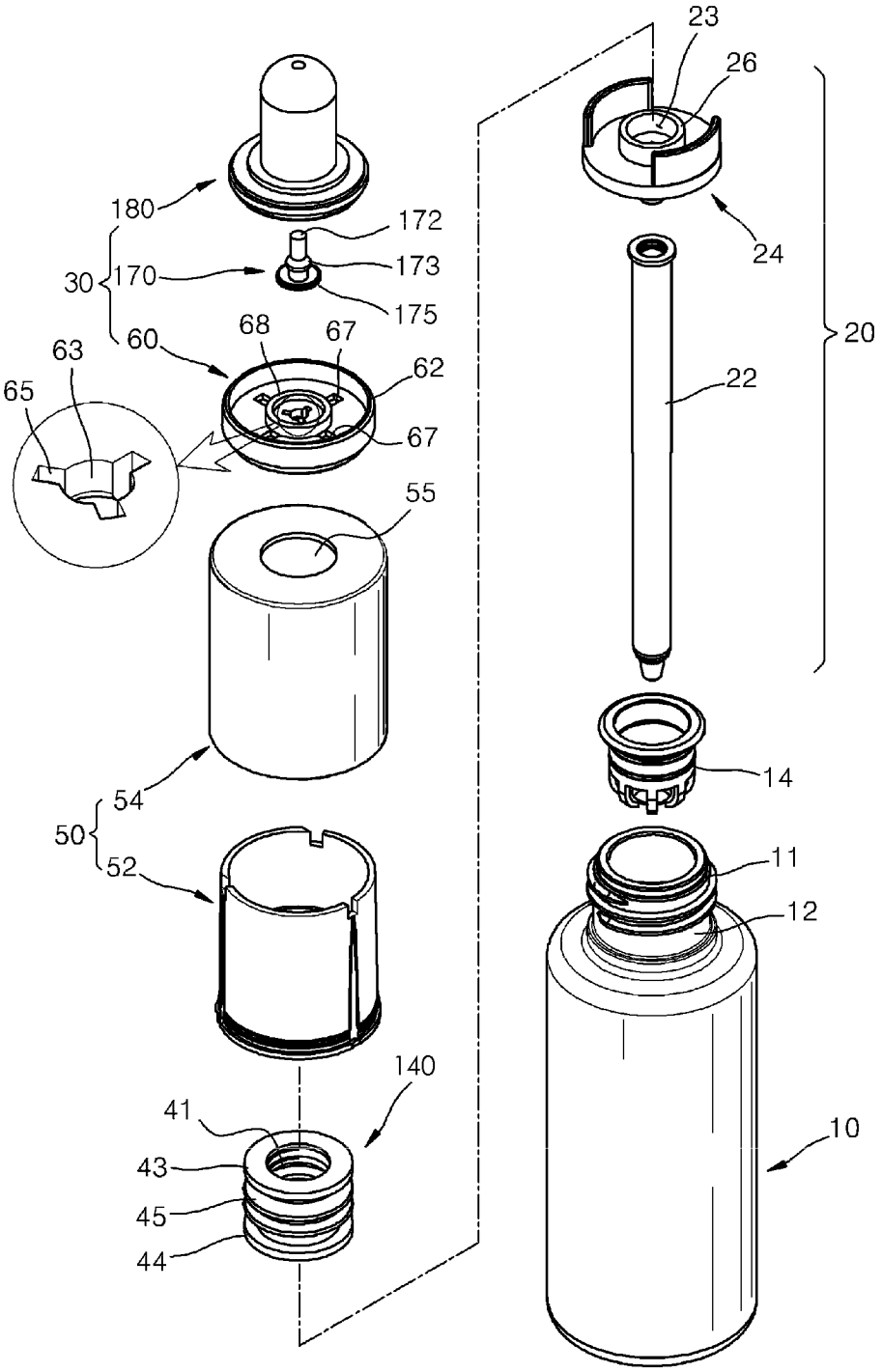
FIG. 30 is an exploded perspective view of FIG. 26.
Figure 31:
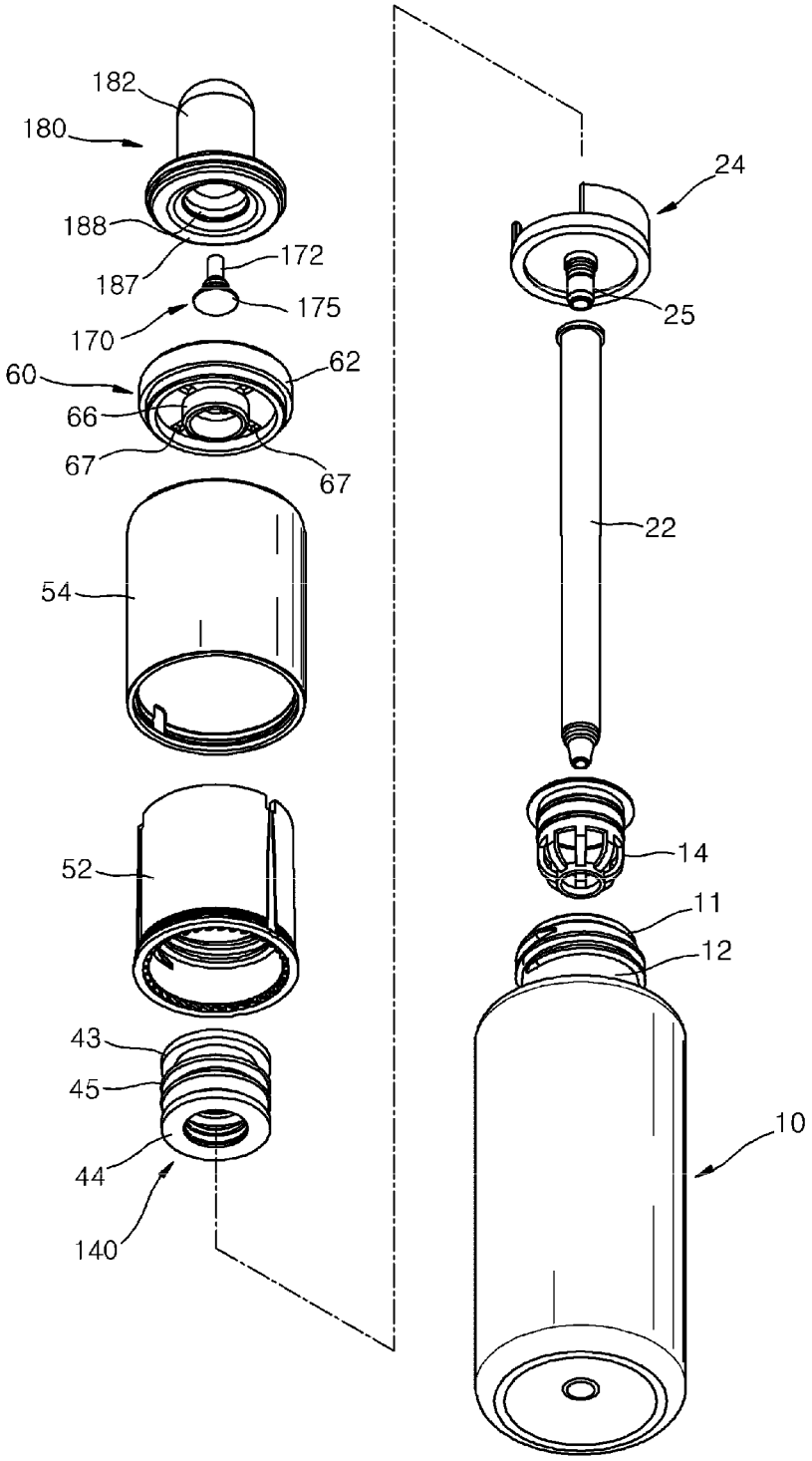
FIG. 31 is an exploded perspective view of FIG. 27.
Figure 32:
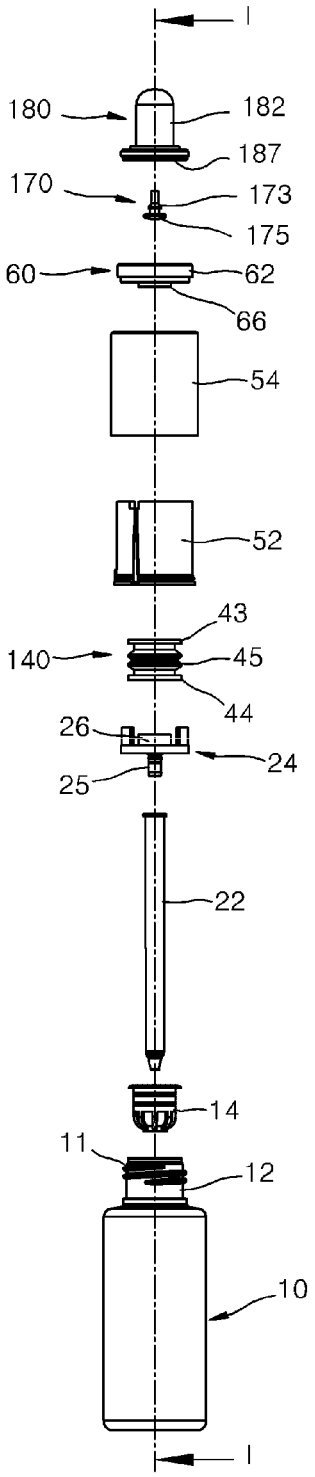
FIG. 32 is a front view of FIG. 30.
Figure 33:
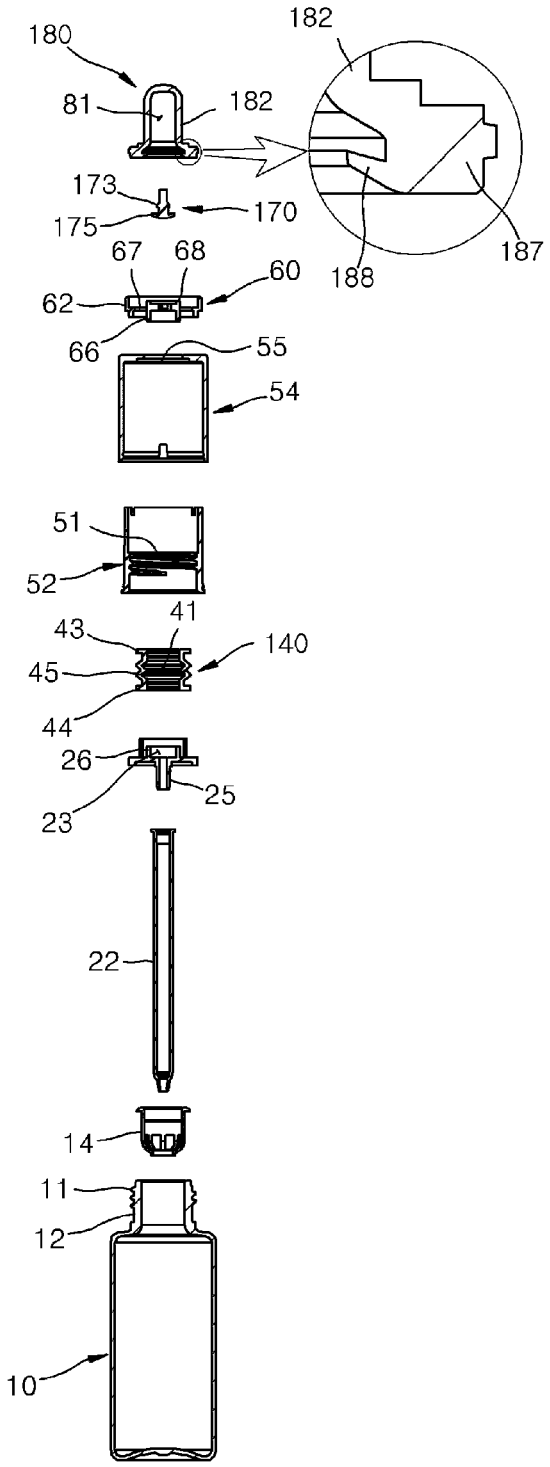
FIG. 33 is a cross-sectional view taken along line I-I of FIG. 32.
Figure 34:
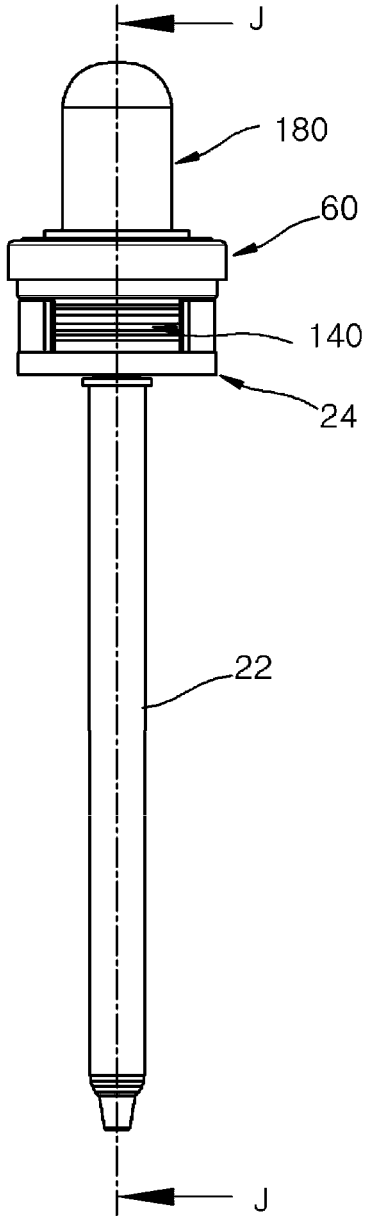
FIG. 34 is a front view illustrating an assembly of a pipette assembly, a bellow, and a pumping assembly in FIG. 32.
Figure 35:
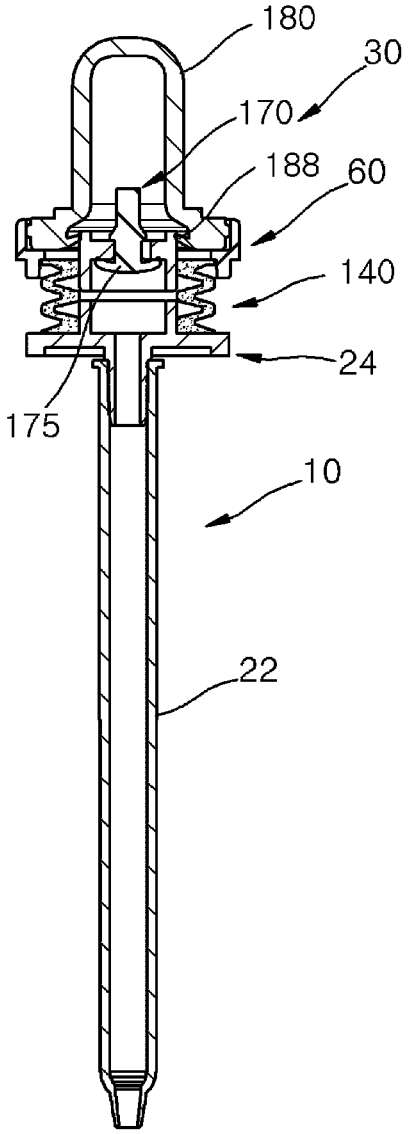
FIG. 35 is a cross-sectional view taken along line J-J of FIG. 9.
Figure 36:
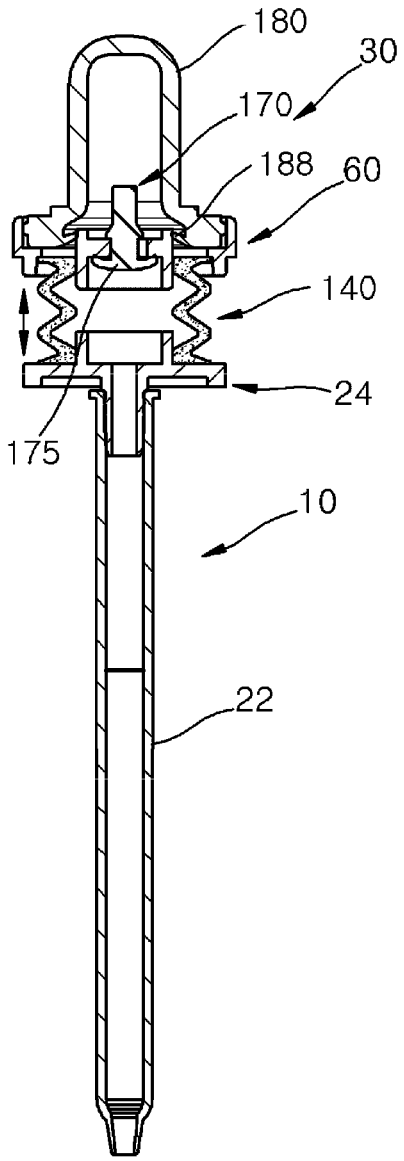
FIG. 36 is a first exemplary view illustrating operation of FIG. 35.
Figure 37:
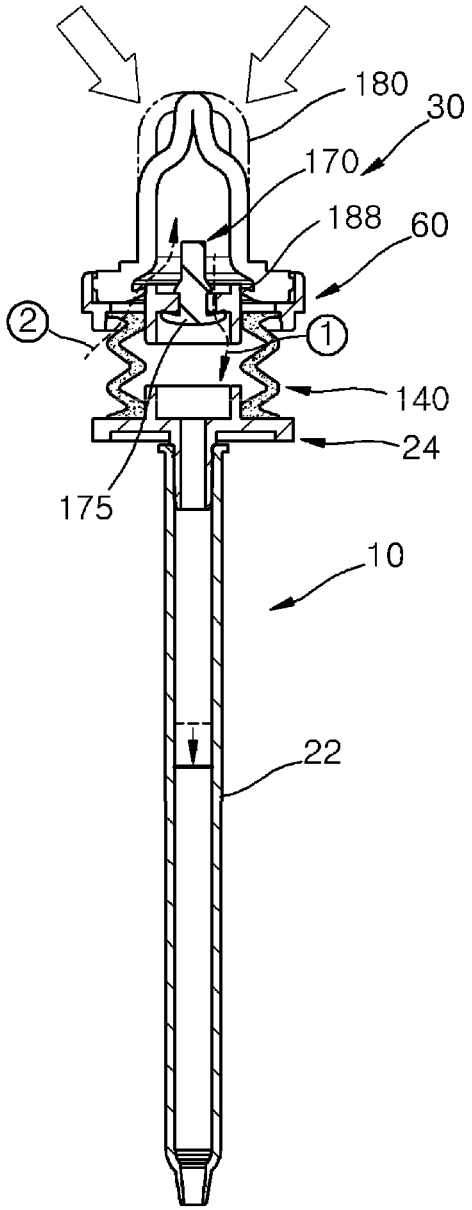
FIG. 37 is a second exemplary view illustrating operation of FIG. 35.

FIG. 26 is a perspective view of an apparatus for automatically filling a pipette according to a second embodiment of the present invention, FIG. 27 is a perspective view the apparatus of FIG. 26, seen from under the apparatus, FIG. 28 is a front view of FIG. 26, FIG. 29 is a cross-sectional view taken along line H-H of FIG. 28, FIG. 30 is an exploded perspective view of FIG. 26, FIG. 31 is an exploded perspective view of FIG. 27, FIG. 32 is a front view of FIG. 30, FIG. 33 is a cross-sectional view taken along line I-I of FIG. 32, FIG. 34 is a front view illustrating an assembly of a pipette assembly, a bellows, and a pumping assembly in FIG. 32, FIG. 35 is a cross-sectional view taken along line J-J of FIG. 9, FIG. 36 is a first exemplary view illustrating operation of FIG. 35, and FIG. 37 is a second exemplary view illustrating operation of FIG. 35.

As illustrated in the figures, an apparatus for automatically filling a pipette according to an embodiment of the present invention includes: a pipette assembly 20 that has a thread 11 on the outer side to be coupled to a container 10 for keeping an substance and is sucked and thus filled with the substance; a pumping assembly 30 that is disposed over the pipette assembly 20, relatively moves toward the pipette assembly 20, and provide a pressure change to the pipette assembly 20 by receiving an operation force from a user; a bellows 140 that is made of a flexible material, connects the pipette assembly 20 and the pumping assembly 30, and is compressed or expanded when the pumping assembly 30 relatively moves; and a housing 50 that receives the pipette assembly 20, the pumping assembly 30, and the bellows 140, and has a thread 51 on the inner side to be coupled to the thread 11 of the container 10.

The container 10 has an inlet 12 at the top and has the thread 11 on the outer side of the inlet 12 and a viscous substance is kept in the container.

A wiper 14 is disposed inside the container inlet 12.

The pipette assembly 20 includes a pipette 22 disposed inside the container 10 and sucking and keeping the substance and a pipette mount 24 having a mount hole 24 for providing pressure to the pipette 22 and fixing the pipette 22.

The pipette 22 is inserted in the container 10 through the wiper 14 in the container inlet 12 and the wiper 14 prevents a substance from being unnecessarily taken out of the container 10 by wiping the substance on the outer side of the pipette 22.

The mount hole 23 is vertically formed through the pipette mount 24, so the pipette mount 24 can provide a pressure change into the pipette 22 through the mount hole 23.

Further, The pipette mount 24 has a pipette fixing portion 25 protruding downward from the bottom and the pipette 22 is fitted on the pipette fixing portion 25.

Further, the pipette mount 24 has a pipette mount fixing portion 26 protruding upward and the bellows 140 is fitted on the bellow fixing portion 26, thereby sealing the container by preventing external air from flowing inside.

Herein, the pipette mount fixing portion 26 is formed around the mount hole 23, and when the bellows 140 is combined, the inside of the bellows 140 and the mount hole 23 communicate with each other.

The bellows 140 is made of a flexible material having elasticity and includes a bellows body 142 having a compression space 41 therein, bellows fixing portions 43 and 44 on the top and the bottom of the bellows body 42, respectively, and a plurality of wrinkles 45 formed on the bellows body 42.

The pumping assembly 30 includes: a pumping mount 60 that is coupled and fixed to the housing 50 and is in close contact with the bellows 140; a pump 180 that is made of an elastic flexible material, keeps air therein, is disposed and fixed between the pumping mount 60 and the housing 50, and supplies compressed air to the bellows 140 through the pumping mount 60; and a check valve member 170 that is disposed in the pumping mount 60, sends the compressed air produced by the pump 180 to the pipette assembly 20 through the pumping mount 60, and prevents air from being sucked into the pump 180 from the pipette assembly 20.

Using the check valve member 170, the pumping mount 60 allows air to flow only to the bellows 140 from the pump 180 and prevents air from flowing in the opposite direction, so the substance in the pipette assembly 20 is discharge in a fixed amount.

Herein, the pumping mount 60 has a pumping body 62, a coupling hole 63 that is formed in the pumping body 62 and through which the check valve member 170 is disposed, a discharge hole 65 that is formed in the pumping body 62, is closed by the check valve member 170, and is opened toward the bellows 140 only when the pump 180 is pressed, a pumping mount fixing portion 66 where the bellows 140 is coupled and fixed, an intake hole 67 that is formed in the pumping body 62, is closed by the pump 180, and is opened toward the inside of the pump 180 only when negative pressure is generated in the pump 180, and a pump mount support 68 that separates the discharge hole 65 and the intake hole 67 and is brought in close contact with the pump 180 in the assembly.

The pumping mount fixing portion 66 is fitted in the bellows fixing portion 43.

The coupling hole 63 is formed vertically through the center of the pumping body 62 and the check valve member 170 is fitted in the coupling hole.

In this embodiment, the discharge hole 65 is connected with the coupling hole 63, but, unlike this embodiment, it may be separated from the coupling hole 63.

Three discharge hole 65 are formed in this embodiment, and the number and shape of the discharge hole 65 may be changed in various ways in accordance with the design factors.

The intake hole 67 is disposed radially outside the discharge hole 65 in close contact with the lower end of the pump 180 over the pumping mount 60, and four intake holes 67 are formed at 90 degrees.

Herein, only when the pressure inside the pump 180 is negative pressure, air is sucked into the pump 180 through the intake holes 67 by a pressure difference.

The check valve member 170 includes a check valve body 172, a check fixing portion 173 formed on the check valve body 172 and locked over the top of the pumping mount 60, and a discharge diaphragm 175 formed in the check valve body 172 and opening/closing the discharge hole 65 under the bottom of the pumping mount 60.

The check valve body 172 is disposed in the pumping mount 60 through the coupling hole 63 and generates locking with the check fixing portion 173 in close contact with the top of the pumping mount 60.

The discharge diaphragm 175 seals the discharge hole 65 in close contact with the bottom of the pumping mount 60.

When positive pressure is generated inside the pump 180, the discharge diaphragm 175 is deformed and opens the discharge hole 65 by the positive pressure, and when the positive pressure is removed, the discharge diaphragm 175 is returned to the initial shape by the elasticity of the material.

Accordingly, in this embodiment, it is preferable that the check valve member 60 is made of elastic synthetic resin to further seal the coupling hole 63 and the discharge hole 65.

The pump 180 includes a pump body 182 having a pumping space 81 therein and a pump sealing portion 187 formed at the lower end of the pump body 182 and seals the intake hole 67 of the pumping mount 60.

The pump body 182 is made of elastic flexible synthetic resin and makes positive pressure inside the pumping space 81 to be deformed when it is pressed by an operation force from a user.

The pump sealing portion 187 seals the intake hole 67 in close contact with the top of the intake hole 67 in the assembly, and when negative pressure is generated in the pumping space 81, it is deformed and opens the intake hole 67 by a pressure difference, so air is sucked into the pumping space 81.

Herein, in order to improve the sealing force on the intake hole 67 and easily make deformation due to a pressure difference, an intake diaphragm 188 protruding toward the pump mount support 68 from the pump sealing portion 187 and being in close contact with the pump mount support 68 is formed.

In particular, the intake diaphragm 188 formed with the end upward.

Accordingly, when positive pressure is generated in the pumping space 81, it is deformed to be in closer contact with the pump mount support 68 by the positive pressure, and when negative pressure is generated, it is deformed and easily separated from the pump mount support 68 by the negative pressure.

The housing 50 includes an inner housing 52 having a thread 51 to be thread-fastened to the container 10 and an outer housing 54 combined with the inner housing 52 and having a pump-through hole 55 to expose the pump 180 of the pump assembly 30.

The inner housing 52 and the outer housing 54 are integrated by coupling after assembling.

The pumping mount 60 fixed to the housing 50, and in this embodiment, it is fitted in between the inner housing 52 and the outer housing 54 and seated on the top of the inner housing 52.

In this embodiment, although the pumping mount 60 is fixed when the inner hosing 52 and the outer housing 54 are combined, it may be fixed to the housing 50 by a specific fastener, unlike this embodiment.

Operation of the apparatus according to the first embodiment of the present invention is described in detail with reference to the drawings.

First, as illustrated in FIG. 4, the apparatus according to this embodiment, when it is coupled to the thread 11 of the container 10, the bellows 140 is compressed by the pipette assembly 20 moving toward the pumping assembly 30, and air in the compression space 41 is discharged into the container through the pipette 22 with the compression of the bellows 140.

Thereafter, when a user separates the apparatus from the container 10 by turning it, in the pipette assembly 20, the bellows 140 returns to the initial state and negative pressure is generated in the compression space 41, and the substance in the container 10 is sucked into the pipette 22 by the negative pressure.

That is, while a user separates the apparatus, the apparatus is filled with a substance.

Next, when a user wants to discharge the sucked substance, he/she presses the pump 180, and the pumping space 81 in the pump 180 is compressed by the operation force from the user.

Herein, since the pump 180 is in close contact with the pumping mount 60, the pumping space 81 of the pumping assembly 30 is sealed, but when it is pressed by the operation force from the user, the discharge diaphragm 175 is deformed and the air in the pumping space 81 is discharged to the pipette assembly 20.

Accordingly, when the pump 180 is pressed, the air in the pumping space 80 moves to the pipette assembly 20 and discharges a fixed amount of the substance in the pipette 22.

Further, the discharge diaphragm 175 is deformed only while air is discharged, and after the air is discharged, it is returned to the initial state by elasticity of the material and seals the pumping space 81.

In particular, even if the user increases the force pressing the pump 180, the air to be discharge is limited, so even if the operation force from the user is increased, the amount of discharged substance is limited, and accordingly, a waste of the substance can be prevented.

Next, even though the user release the pump 180, the discharge diaphragm 175 keeps the discharge hole 65 closed, so air flow is not generated under the discharge diaphragm 175 and the substance in the pipette 22 can be prevented from being moved upward again.

Herein, when the operation force applied to the pump 180 is removed, the pump 180 returns to the initial shape and negative pressure is generated in the pumping space 81, the intake diaphragm 188 is opened by the negative pressure, and external air flows into the pumping space 81 through the intake hole 67.

In the apparatus according to this embodiment, when a user presses the pump 180, a discharge channel $\overline{1}$ for air is formed to the pipette assembly 20, and when the pump 180 is returned, an intake channel $\overline{2}$ for sucking external air into the pumping space 81 is formed, so even if the pump 180 is repeatedly operated, only a fixed amount of substance is discharged.

Although exemplary embodiments of the present invention were described above with reference to the accompanying drawings, the present invention is not limited thereto and those skilled in the art would understand that the present invention may be implemented in various ways without changing the necessary features or the spirit of the prevent invention. Therefore, it should be understood that the exemplary embodiments are not limiting but illustrative in all aspects.

The invention claimed is:

1. An apparatus constructed to automatically fill a pipette (22) with a substance from a container (10), the apparatus comprising:

a pipette assembly (20) constructed to suck the substance from the container (10) thus filling the pipette (22) with the substance;

a pumping assembly (30) that is disposed over the pipette assembly (20), relatively moves to the pipette assembly (20), and provides a pressure change from a pumping space (81) to the pipette assembly (20);

a bellows that is made of an elastic material and connects the pipette assembly (20) and the pumping assembly (30) that are relatively moveable to each other; and a housing (50) which includes a thread (51) on an inner side of the housing (50) that is couplable to a thread (11) of the container (10), wherein the pumping assembly (30) is fixed to the housing (50), and wherein the pumping assembly (30) comprises:

a discharge hole (65) that connects the pumping space (81) and the pipette assembly (20);

an intake hole (67) connected with the pumping space (81) such that external air flows into the pumping space (81);

a pumping mount (60) that is fixed to the housing (50), to which the bellows is coupled, and that has the discharge hole (65) and the intake hole (67);

a discharge diaphragm (175) constructed to seal the discharge hole (65) and open the sealed discharge hole (65) by pressure difference when positive pressure is generated in the pumping space (81);

an intake diaphragm (188) constructed to seal the intake hole (67) and open the sealed intake hole (67) by pressure difference when negative pressure is generated in the pumping space (81);

a pump (180) that has the pumping space (81) therein and has an intake diaphragm (188), disposed between the pumping mount (60) and the housing (50), constructed to close the intake hole (67) by pressure difference only when negative pressure is generated in the pumping space (81); and a check valve member (170), disposed in the pumping mount (60), constructed to close the discharge hole (65) and open the discharge hole only when positive pressure is generated in the pumping space (81) such that air in the pumping space (81) flows to the bellows.

2. The apparatus of claim 1, wherein the discharge hole (65) allows discharged air to flow to the pipette assembly (20) and wherein the intake hole (67) allows external air to flow into the pumping space (81).

3. The apparatus of claim 1, wherein the pumping mount (60) comprises:

a pumping body (62) coupled and fixed to the housing (50);

a pumping mount fixing portion (66) where the bellows is coupled and fixed; and a pump mount support (68) constructed to separate the discharge hole (65) and the intake hole (67) and is in contact with the pump (180) in the pumping assembly (30), wherein the pumping body (62) comprises:

a coupling hole (63) through which the check valve member (170) is disposed;

the discharge hole (65) that is closed by the check valve member (170) and is opened towards the bellows only when positive pressure is generated in the pumping space (81); and the intake hole (67) that is closed by the pump (180) and is opened towards the inside of the pumping space (81) only when negative pressure is generated in the pumping space (81).

4. The apparatus of claim 3, wherein the housing (50) is configured to be thread-fastened to the container (10) to allow the bellows to contract by relatively moving toward the pipette assembly (20) and the pumping assembly (30), and wherein the housing is configured to be separated from the container (10) to allow the bellows to expand by relatively moving away from the pipette assembly (20) and the pumping assembly (30).

5. The apparatus of claim 2, wherein the housing (50) is configured to be thread-fastened to the container (10) to allow the bellows to contract by relatively moving toward the pipette assembly (20) and the pumping assembly (30), and wherein the housing is configured to be separated from the container (10) to allow the bellows to expand by relatively moving away from the pipette assembly (20) and the pumping assembly (30).

6. The apparatus of claim 1, wherein the housing (50) is configured to be thread-fastened to the container (10) to allow the bellows to contract by relatively moving toward the pipette assembly (20) and the pumping assembly (30), and wherein the housing is configured to be separated from the container (10) to allow the bellows to expand by relatively moving away from the pipette assembly (20) and the pumping assembly (30).

7. An apparatus constructed to automatically fill a pipette (22) with a substance from a container (10), the apparatus comprising:

a pipette assembly (20) to suck the substance from the container (10) thus filling the pipette (22) with the substance;

a pumping assembly (30) that is disposed over the pipette assembly (20), relatively moves to the pipette assembly (20), and provides a pressure change from a pumping space (81) to the pipette assembly (20);

a bellows that is made of an elastic material and connects the pipette assembly (20) and the pumping assembly (30) that are relatively moveable to each other; and a housing (50) which includes a thread (51) on an inner side of the housing (50) that is couplable to a thread (11) of the container (10), wherein the pumping assembly (30) is fixed to the housing (50), and wherein the pumping assembly (30) comprises:

a pumping mount (60) that is coupled and fixed to the housing (50) in contact with the bellow (40);

a discharge hole (65) constructed to connect the pumping space (81) and the pipette assembly (20);

an intake hole (67) connected with the pumping space (81) such that external air flows into the pumping space (81);

a discharge check valve (70), disposed in the pumping mount (60), opens or closes the discharge hole (65) in accordance with a pressure difference of the pumping assembly (30);

an intake check valve (90), disposed in the pumping mount (60), opens or closes the intake hole (67) in accordance with a pressure difference of the pumping assembly (30); and a pump (80) made of an elastic flexible material, keeps air in the pumping space (81) formed therein, is disposed between the pumping mount (60) and the housing (50), and provides compressed air to the bellows through the pumping mount (60), wherein the pump (80) includes an intake diaphragm (94), disposed between the pumping mount (60) and the housing (50), constructed to close the intake hole (67) and opening the intake hole (67) by pressure difference only when negative pressure is generated in the pumping space (81), and wherein the discharge check valve (70) is disposed in the pumping mount (60) to close the discharge hole (65) and open the discharge hole (65) only when positive pressure is generated in the pumping space (81) such that air in the pumping space (81) flow to the bellows.

8. The apparatus of claim 7, wherein the pumping mount (60) comprises:

a pumping body (62) that is disposed between the housing (50) and the pump (80);

a pumping mount fixing portion (66) where the bellows is coupled and fixed; and a pump mount support (68) constructed to separate the discharge hole (65) and the intake hole (67) and is in contact with the pump (80) in the pumping assembly (30), wherein the pumping body (62) comprises:

the discharge hole (65) that is closed by the discharge check valve (70) and is opened towards the bellows only when positive pressure is generated in the pump (80) by the pressing the pump (80); and the intake hole (67) that is closed by the intake check valve (90) and is opened towards the inside of the pump (80) only when negative pressure is generated in the pump (80).

9. The apparatus of claim 8, wherein the housing (50) is configured to be thread-fastened to the container (10) to allow the bellows to contract by relatively moving toward the pipette assembly (20) and the pumping assembly (30), and wherein the housing is configured to be separated from the container (10) to allow the bellows to expand by relatively moving away from the pipette assembly (20) and the pumping assembly (30).

10. The apparatus of claim 7, wherein the bellows is constructed to expand to allow the substance of the container (10) to be sucked into the pipette assembly (20).

11. The apparatus of claim 7, wherein the housing (50) is configured to be thread-fastened to the container (10) to allow the bellows to contract by relatively moving toward the pipette assembly (20) and the pumping assembly (30), and wherein the housing is configured to be separated from the container (10) to allow the bellows to expand by relatively moving away from the pipette assembly (20) and the pumping assembly (30).

12. The apparatus of claim 7, wherein the discharge hole (65) allows discharged air to flow to the pipette assembly (20), wherein the intake hole (67) allows external air to flow to the pumping space (81) of the pumping assembly (30), wherein the discharge check valve (70) is constructed to allow air to flow to the pipette assembly (20) through the pumping mount (60) when the pressure inside the pump (80) is positive pressure, and constructed to prevent air flowing to the pump (80) from the pipette assembly (20) when the pressure inside the pump (80) is negative pressure, and wherein the intake check valve (90) is constructed to allow external air to flow into the pump (80) through the pumping mount (60) when the pressure inside the pump (80) is negative pressure, and constructed to prevent air in the pump (80) from being discharged when the pressure inside the pump (80) is positive pressure.

13. The apparatus of claim 12, wherein the bellows is constructed to expand to allow the substance of the container (10) to be sucked into the pipetter assembly (20).

14. The apparatus of claim 12, wherein the housing (50) is configured to be thread-fastened to the container (10) to allow the bellows to contract by relatively moving toward the pipette assembly (20) and the pumping assembly (30), and wherein the housing is configured to be separated from the container (10) to allow the bellows to expand by relatively moving away from the pipette assembly (20) and the pumping assembly (30).

* * * * *